US007805846B2

(12) United States Patent
Leventhal et al.

(10) Patent No.: US 7,805,846 B2
(45) Date of Patent: Oct. 5, 2010

(54) RETRACTABLE RAZOR ASSEMBLY

(75) Inventors: James M. Leventhal, Boston, MA (US); Bernard Fabricant, Lexington, MA (US)

(73) Assignee: Clio Designs, Inc., Watertown, MA (US)

( * ) Notice: Subject to any disclaimer, the term of this patent is extended or adjusted under 35 U.S.C. 154(b) by 14 days.

(21) Appl. No.: 12/407,995

(22) Filed: Mar. 20, 2009

(65) Prior Publication Data

US 2009/0178286 A1 Jul. 16, 2009

Related U.S. Application Data

(62) Division of application No. 10/633,179, filed on Aug. 1, 2003, now Pat. No. 7,611,013.

(60) Provisional application No. 60/468,423, filed on May 7, 2003, provisional application No. 60/436,325, filed on Dec. 24, 2002.

(51) Int. Cl.
*B26B 21/52* (2006.01)

(52) U.S. Cl. ..... 30/526; 30/527

(58) Field of Classification Search ..... 30/526–536; D28/46, 48; 132/289–292; 294/19.1
See application file for complete search history.

(56) References Cited

U.S. PATENT DOCUMENTS

| | | | | | |
|---|---|---|---|---|---|
| 338,047 | A | * | 3/1886 | Ehrlich | 30/335 |
| 1,176,780 | A | * | 3/1916 | Roth | 30/63 |
| 1,749,051 | A | * | 3/1930 | Watt | 30/526 |
| 1,909,595 | A | * | 5/1933 | Segal | 30/35 |
| 2,053,550 | A | | 9/1936 | Chodaczok | 30/47 |
| 2,059,172 | A | * | 10/1936 | Sabiers | 30/527 |
| 2,089,283 | A | * | 8/1937 | McKenzie | 30/526 |
| 2,298,944 | A | * | 10/1942 | Hyatt | D28/46 |
| 2,351,395 | A | | 6/1944 | Broder | 206/56 |
| 2,512,953 | A | | 6/1950 | Maduff et al. | 30/47 |
| 2,725,626 | A | | 12/1955 | Baker | 30/40 |
| 2,780,351 | A | | 2/1957 | Grisel | 206/56 |
| 2,844,870 | A | * | 7/1958 | Roces et al. | 30/526 |
| 3,038,254 | A | * | 6/1962 | Scheminger, Jr. | 30/526 |
| 3,557,448 | A | * | 1/1971 | Shead | D28/46 |
| 3,703,765 | A | * | 11/1972 | Perez | 30/41 |
| 3,817,636 | A | | 6/1974 | Ritzenhoff | 401/78 |
| 3,850,183 | A | | 11/1974 | Gruska | 132/88.7 |
| 3,878,605 | A | * | 4/1975 | Braginetz | 30/526 |

(Continued)

*Primary Examiner*—Jason Daniel Prone
(74) *Attorney, Agent, or Firm*—Mintz Levin Cohn Ferris Glovsky and Popeo, P.C.

(57) ABSTRACT

A retractable razor assembly includes a foldable blade support for mounting a razor blade or cartridge, and a mounting assembly connected to the blade support that can extend and retract the blade support from a handle and can stabilize the foldable blade support when extended. The adjustment assembly, when extended from the handle, remains substantially stationary to promote stability of the blade or cartridge, and to thereby promote comfort and safety during use of the razor assembly. A packaging system for containing and for displaying operation of the retractable razor includes at least a portion that provides visual inspection of the razor assembly. The packaging system further enables a consumer to physically interact with the razor assembly while contained therein. The packaging system permits a consumer to actuate the adjustment assembly to display its extension and retraction, and to provide a demonstration of the different operating states of the razor assembly.

10 Claims, 18 Drawing Sheets

U.S. PATENT DOCUMENTS 3,934,591 A * 1/1976 Gleason ..... 30/329
4,208,144 A 6/1980 Idec et al. ..... 401/192
4,332,321 A 6/1982 Wratschko ..... 206/228
4,461,078 A * 7/1984 Carreker ..... 30/526
4,514,102 A 4/1985 Ackerman et al. ..... 401/78
4,750,501 A * 6/1988 Ackermann et al. ..... 132/318
4,905,372 A 3/1990 Willis ..... 30/85
5,009,004 A 4/1991 Yen ..... 30/47
5,014,427 A * 5/1991 Byrne ..... 30/535
D325,652 S * 4/1992 Byrne ..... D28/46
5,167,069 A 12/1992 Quinn ..... 30/89
5,388,599 A 2/1995 Yen ..... 132/311
5,465,488 A 11/1995 Yaw et al. ..... 30/41
5,472,250 A * 12/1995 Schlangen ..... 294/19.1
D370,742 S * 6/1996 Chase ..... D28/46
5,608,972 A * 3/1997 Tsae-Chyn ..... 30/526
5,704,127 A * 1/1998 Cordio ..... 30/529
5,911,480 A 6/1999 Morgan ..... 30/41
6,052,905 A 4/2000 Branchinelli et al. ..... 30/50
D431,681 S * 10/2000 Seger ..... D28/48
6,189,222 B1 * 2/2001 Doyle ..... 30/531
6,266,888 B1 7/2001 Zowaski ..... 30/527
D472,673 S * 4/2003 Carvotta et al. ..... D28/48
D489,485 S * 5/2004 Leventhal et al. ..... D28/46
D490,568 S * 5/2004 Leventhal et al. ..... D28/46
D500,172 S * 12/2004 Fields ..... D28/46
6,830,552 B1 * 12/2004 Gonzalez ..... D28/91.2
D507,379 S * 7/2005 Alphonso ..... D28/48
6,915,580 B2 * 7/2005 Dassel ..... 30/526
6,928,738 B2 * 8/2005 Segrea ..... 30/535
7,028,407 B2 * 4/2006 Ehrlich et al. ..... 30/526
D560,032 S * 1/2008 Lopez ..... D28/48
7,611,013 B2 * 11/2009 Leventhal et al. ..... 206/463
D605,362 S * 12/2009 Andersen ..... D28/48
D611,653 S * 3/2010 Marut ..... D28/46
D611,655 S * 3/2010 Askew ..... D28/48
2003/0177648 A1 * 9/2003 Zeiter ..... 30/526
2003/0204958 A1 * 11/2003 Jewell ..... 30/537
2003/0208914 A1 * 11/2003 Ehrlich et al. ..... 30/526
2004/0107585 A1 * 6/2004 Helmrich ..... 30/537
2004/0118724 A1 * 6/2004 Leventhal et al. ..... 206/352
2006/0101655 A1 * 5/2006 Givant ..... 30/523
2006/0162165 A1 * 7/2006 Villalobos ..... 30/32
2007/0062043 A1 * 3/2007 Marut ..... 30/50
2007/0227015 A1 * 10/2007 Collins ..... 30/526
2008/0110025 A1 * 5/2008 Bucalo ..... 30/526
2009/0100679 A1 * 4/2009 Casciaro et al. ..... 30/526

* cited by examiner

RETRACTABLE RAZOR ASSEMBLY

CLAIM OF PRIORITY TO PRIOR APPLICATIONS

This application is a divisional application of application Ser. No. 10/633,179, now U.S. Pat. No. 7,611,013 B2, filed Aug. 1, 2003, which claims priority under 35 U.S.C. §119(e) to U.S. provisional patent application Ser. No. 60/468,423, filed on May 7, 2003, and U.S. provisional patent application Ser. No. 60/436,325, filed on Dec. 24, 2002, which are incorporated herein by reference.

FIELD OF THE INVENTION

The invention relates generally to a retractable razor assembly and a packaging system to contain and to display features of the assembly.

BACKGROUND OF THE INVENTION

Conventional personal razors are typically constructed of a blade mounted to a handle. For safety purposes, it is desirable to cover the mounted blades when not in use to reduce the potential for injury from accidental contact with blades and to protect the blades when not in use. These devices typically include fitted blade caps and devices for storing razors in fixed locations. Blade caps are difficult to secure effectively to mounted blades, and are easily misplaced or lost. Further, when disposed over blades, blade caps tend to trap water and debris on blades, making thorough drying and cleansing of blade surfaces difficult. Water and debris shorten the useful life of blades and cause blades to become dangerous to use. Devices that store razors in fixed locations can allow more effective drying and cleansing of blade surfaces, but typically are not practical or safe for carrying, transporting or storing razors.

One solution includes personal razors designed as foldable and retractable razors with propel/retraction mechanisms that allow blade mounting portions to fold and to retract such that mounted blades are housed within razor handles, allowing the blades to be stored, transported or otherwise handled safely. Such conventional retractable razor designs can include a retractable mounting assembly or fixture configured to mount a razor blade or cartridge. Mounting assemblies or fixtures provide for retraction of a mounted blade, but often do not provide sufficient stability to the mounted blade. Mounting assemblies or fixtures are typically constructed of small and/or movable supports or extensions that do not provide sufficient or reliable resistance to pressure when manually applied to the razor during use. Mounting assemblies or fixtures can wobble and/or fold/retract during use of a razor rendering the mounted blade unstable and unsafe. Without stable blade support, a retractable razor creates the potential for discomfort and personal injury during use. In addition, instability of other moving elements of retractable razor designs and substantial variance between contact points of such elements can cause further instability to a mounted blade.

An example of a retractable razor having a mounting assembly appears in U.S. Pat. No. 5,009,004 (Yen). Yen discusses a foldable razor assembly that includes a blade support mounted to a first moving portion and a second, larger moving portion. When the first moving portion reaches a resting position, the blade support is then pivoted on the second moving portion as the second, larger moving portion continues to extend. The blade, however, is not sufficiently supported using this embodiment.

Personal razors, like many personal care products, are typically packaged and sold in conventional packaging designs that display products and, in many cases, dispense products. In addition, personal care products like razors can be packaged in designs for display and sale from fixtures, such as peg hooks and dispensing units typically located in aisles, at checkout counters and at point-of-sale locations in retail stores. Such packaging designs prevent damage to products during display, storage and transport, and maintain personal care products in hygienic condition. Packaging designs can be further configured to prevent physical harm to consumers and other persons who handle or come into contact with such packaging.

Product packaging that is visually attractive and stands out from other types of packaging can draw the attention of consumers and encourage consumers to inspect products contained within the packaging. In addition to visual attractiveness, product packaging that provides consumers with an opportunity to appreciate one or more features of a product is advantageous. For example, packaging that allows consumers to interact with a product, e.g., activate or manipulate the product, while the product is disposed within the packaging provides consumers with an opportunity to appreciate the features and functions of the product. It is well known that consumers are significantly more likely to purchase a product that operates at variable states, if they are permitted to interact with the product and to activate and visually appreciate each of the product's states.

Conventional packaging designs for retractable razors and other personal care products cannot readily package a retractable razor, as required for safety and for preventing contamination, and further provide consumers with an ability to both visually inspect and physically interact with the razor. Conventional packaging for retractable razors and personal care products typically includes, for example, paper, plastic, cellophane or acetate bags, paper boxes, plastic-wrapped support or insert cards and the like, which contain products, but do not enable consumers to interact with the products.

Thus, it is desirable to provide a retractable razor configured to provide stable blade support that promotes and insures ease and comfort during use of the razor. It is also desirable that a retractable razor has a construction to permit the razor to be disposed in a packaging design that permits a consumer to interact or manipulate the razor while packaged and to thereby gain an appreciation of its features and functions. It is further desirable to provide a packaging system that can contain and display a consumer product including a retractable razor that insures the integrity of the product and allows visual inspection and physical interaction with the product while disposed therein.

SUMMARY OF THE INVENTION

The present invention relates to an improved retractable razor and packaging system. Embodiments of the invention include a blade support assembly including a blade support and a first mounting element operatively coupled to a second mounting element. The blade support includes a first surface configured to mount one of a razor blade and a blade cartridge and second surface configured to define a fixing stem for connection to the first mounting element, the first mounting element defining a hole configured to accept the fixing stem to movably connect the blade support to the first mounting element. The second mounting element is movably connected to the first mounting element to slide along the first mounting element, and is further configured to couple with the blade support such that, when the second mounting element slides along the first mounting element, the second mounting element engages the blade support to extend and fold the blade support. The retractable razor further includes a handle assembly including an outer cylinder defining a chamber and having at least a first open end, and an actuating mechanism disposed within the chamber, the actuating mechanism being operatively connected to the first and the second mounting elements such that when activated, the actuating mechanism extends and retracts the blade support assembly from and into the handle chamber. Further included is an actuating element disposed at a second end of the outer cylinder and operatively connected to the actuating mechanism, the actuating element being configured and disposed to rotate to thereby operate the actuating mechanism.

Implementations of the invention may include one or more of the following features. The actuating mechanism can include an inner cylinder configured such that the outer cylinder receives the inner cylinder through its first open end, and can be further configured to operatively couple to the actuating element such that rotation of the actuating element rotates the inner cylinder. The inner cylinder can define one or more tabs in its outer surface, each tab being disposed and configured for insertion into a notch defined along an inner surface of the actuating element to securely connect the inner cylinder to the actuating element. The inner cylinder can further be configured to receive the first mounting element operatively coupled to the second mounting element to dispose the first and the second mounting elements therein. The inner cylinder can also define at least a first slot and a second slot along its length, the first slot being disposed and configured to accept a first protruding stem defined in the first mounting element, and the second slot being disposed and configured to accept a second protruding stem defined in the second mounting element such that the first and the second mounting elements move along the length of the inner cylinder. The first slot and second slot can be asymmetrically disposed on opposite sides of the inner cylinder. The first slot and the second slot can have the same or different heights. The first slot and the second slot can have different widths and the first protruding stem and the second protruding stem can have different sizes such that the first slot is configured to accept exclusively the first protruding stem and the second slot is configured to accept exclusively the second protruding stem.

Further implementations of the invention may include one or more of the following features. The outer cylinder can define two spiral guide slots along an inner surface, each spiral guide slot extending from a lower region to an upper region of the outer cylinder adjacent to the first open end, each spiral guide slot being disposed and configured to receive one of the first and the second protruding stems such that when the inner cylinder rotates the first and second protruding stems slide along the spiral guide slots. At least one of the spiral guide slots can be further configured at the upper region to terminate to a detent defined in the inner surface of the outer cylinder, the detent being disposed and configured to receive one of the first and second protruding stems. The detent can be configured such that when the detent accepts one of the first and the second protruding stems, the blade support assembly is extended from the outer cylinder in a substantially stationary position. The outer cylinder can include a shape that promotes a manual grip. The shape can define a convex outer profile. The shape can otherwise define a concave outer profile. At least a portion of an outer surface of the outer cylinder can include a coating of a material that promotes a manual grip. The material can include a material that promotes a manual grip when the outer cylinder is wet. The material can define a texturized surface. The material can include a material selected from the group consisting of a rubber, a synthetic rubber, a plastic, a thermoplastic polymer, and any combination thereof.

In another aspect, the invention provides a packaging system for containing and for displaying a product. The packaging system includes a clamshell housing including a first portion and a second portion, the first portion removably connected to the second portion and, when connected, defining a chamber to dispose the product therein. The first portion and the second portion further define an internal configuration to accommodate a shape of the product, and a first closed end and a second open end, wherein when the product is disposed in the chamber, at least a portion of the product extends from the second open end of the housing. The packaging system further includes an insert card disposed between the first portion and the second portion and being substantially planar to support the housing, the insert card having an interior notch disposed and configured to accommodate the chamber of the housing.

Implementations of the invention can include one or more of the following features. The first portion and the second portion can be constructed at least in part of a transparent material to provide visual inspection of the product. A perimeter edge of the interior notch can define one or more tabs, each tab disposed to face the chamber and being configured to couple with the product when disposed in the chamber. An outer surface of the product can include one or more recesses, each recess being configured to receive and to mate with one of the tabs such that when the product is disposed in the chamber, each recess receives a tab.

Implementations of the invention can further include one or more of the following features. The first portion and the second position can have a substantially similar size and a substantially similar shape. The first portion and the second portion can define at least an upper section of a first shape and a first size, and at least lower section of a second shape and a second size to thereby accommodate the shape of the product. The first portion and the second portion can further define one or more sections of a first shape and a first size, and one or more sections of a second shape and a second size to accommodate the shape of the product. The first portion and the second portion can define one or more sections having one or more shapes and one or more sizes to accommodate the shape of the product.

In implementations of the invention, the product can be a retractable razor. The portion of the product extending from the second open end of the packaging can include an actuating element configured to activate the retractable razor. The first portion and the second portion can be constructed at least in part of a transparent material to provide visual inspection of the retractable razor. The first portion and the second portion can define an upper section having an internal size and an internal shape to accommodate one or more moving elements of the retractable razor. The internal size and the internal shape of the upper section can provide clearance to permit a movable blade support assembly of the retractable razor to move into one or more operating positions without contacting the upper section. The first portion and the second portion can define a lower section having an internal size and an internal shape to accommodate a handle of the retractable razor. The handle can define a convex outer profile. A perimeter edge of the interior notch can define one or more tabs, each tab disposed to face the chamber and being configured to couple with the retractable razor when disposed in the chamber. An outer surface of the handle of the retractable razor can define one or more recesses, each recess being configured to receive and to mate with one of the tabs such that when the retractable razor is disposed in the chamber, each recess receives a tab. The retractable razor can remain in a substantially stationary position within the housing when the actuating element activates the retractable razor to one or more operating positions.

In yet another aspect, the invention provides a system for containing an item and for displaying operation of the contained item. The system includes an item having one or more moving elements constructed and arranged to activate the item to one or more operating states, the item having an actuating element operatively connected to one or more of the moving elements such that manipulation of the actuating element causes one or more of the moving elements to activate the item to one or more of the operating states. The system further includes a packaging assembly constructed and arranged to contain the item, the packaging assembly defining an internal configuration sized and configured to contain the item within the packaging assembly and to permit the item to activate to one or more of the operating states, at least a portion of the packaging assembly being constructed of a material for providing a visual inspection of at least a portion of the item, the packaging assembly being further configured to permit at least a portion of the actuating element to extend from the packaging assembly to permit access to and manipulation of the actuating element from an area external to the packaging assembly. When the actuating element is manipulated, a display of the item activating to one or more of the operating states is provided.

Implementations of the invention include one or more of the following features. A portion of the internal configuration can be configured to couple the item with the packaging system and to dispose the item in a substantially stationary position within the packaging system. The portion of the internal configuration can define one or more protrusions and the item defines one or more recesses in its surface, each recess being disposed and configured to receive and to mate with one of the protrusions. The system can include a clasp configured to couple with the item and to couple the item with the packaging system, and to dispose the item in a substantially stationary position within the packaging system. A portion of the internal configuration may define one or more recesses and the clasp defines one or more tabs, each recess being disposed and configured to receive and to mate with one of the tabs when the item is disposed in the packaging system. The internal configuration of the packaging system may include a first portion to accommodate one or more stationary/nonmoving elements of the item and a second portion to accommodate one or more of the moving elements of the item. The first portion of the internal configuration can be sized and configured to provide an internal clearance to permit the item to activate to one or more of the operating states. The second portion of the internal configuration can be sized and configured to conform to a shape of the nonmoving/stationary elements of the item. The product can be a retractable razor. The product can alternatively be a retractable toothbrush.

Various aspects of the invention may provide one or more of the following advantages.

A foldable and retractable personal razor assembly can be provided that includes a folding and retracting blade support assembly and a handle assembly configured to serve as a razor handle and as a storage device. The blade support assembly can be operatively connected to a propel/retraction mechanism disposed in the handle assembly that enables the blade support assembly to be propelled from and retracted into the handle assembly for storage and safety. The blade support assembly can be configured to accept and to mount a conventional razor blade or cartridge.

The blade support assembly can be further configured as a substantially stationary fixture when extended from the handle assembly such that during use of the razor assembly, the blade support assembly remains in a substantially fixed position. The blade support assembly thereby can promote stability of the mounted blade or cartridge during use of the razor assembly. The configuration of the blade support assembly can prevent/decrease variance or "play" of connections between the blade support assembly and other elements of the razor assembly to promote stability of the blade support assembly and the blade or cartridge mounted thereto.

The blade support assembly can be sized and configured such that when pressure is applied manually to the razor assembly during use, the blade support assembly can provide sufficient resistance against such pressure to remain in a substantially fixed position when extended from the handle assembly to help to maintain stability of the blade or cartridge. Increasing stability of the blade support assembly, and thereby increasing the stability of the blade or cartridge, can promote safety and ease of use of the razor assembly.

To further promote stability of a razor assembly, other movable elements of the razor assembly can be configured and operatively arranged to eliminate/reduce the variance potential between connections and contact points of such elements of the razor assembly, as well as to eliminate/reduce a potential of loosening of the elements. In addition, increasing overall mass of movable elements can further promote stability of the razor assembly. For instance, an actuating element disposed at a terminal end of the handle assembly to actuate a propel/retraction mechanism disposed therein can be configured as a secure and permanent connection to the handle assembly. The actuating element can be further configured as a solid unit to add mass to the razor assembly to help to enhance stability and thereby safety of the razor assembly.

The handle assembly can be configured and sized to store the retracted blade support assembly to help to protect blades or cartridges from damage and debris, and to help to shield users from blades or cartridges when the razor assembly is not in use. The handle assembly permits the razor assembly to be essentially portable, and easily and safely stored and transported.

The handle assembly can be designed and configured such that the assembly defines a shape or conformation and an outer contour to provide an ergonomically comfortable and secure grip. Such a comfortable, secure grip can facilitate an effective and safe shaving experience. The handle assembly can be configured in a range of shapes and outer contours to fit different hand sizes.

The handle assembly can be further configured with a coat or a coating on its external surface consisting of a material, e.g., a rubberized material or the like, suitable for promoting a user's manual grip. The coat or coating helps to facilitate ease and comfort in maintaining a grip when the razor assembly is in use and the handle assembly is wet and/or soapy. Stability, comfort, safety and ease of use of the razor assembly can be promoted and enhanced by the coat or coating and the shape and the contour of the handle assembly. The handle assembly can be constructed of materials suitable for adding mass but not significant weight to the razor assembly, for withstanding wet conditions, and for promoting the aesthetic appearance and features of the razor assembly to enhance its marketability.

The handle assembly can further define a shape or conformation and an outer contour configured to enable the razor assembly to be disposed in a packaging system that contains and displays the assembly, while enabling a portion of the assembly to remain accessible, e.g., exposed, such that a consumer can interact and operate the assembly when contained in the packaging system.

The handle assembly can define a substantially convex or concave shape to define a substantially convex or concave outer contour to help to fix the razor assembly within a packaging system. The handle assembly can further define one or more mounting elements, e.g., slots or tabs, in its surface that can conform with and/or mate to corresponding mounting elements, e.g., tabs or slots, defined in the packaging system. The mounting elements help to securely dispose the razor assembly within a packaging system and to insure the razor assembly remains substantially stationary therein.

A packaging system can be provided that is designed and configured to contain and to display a uniquely shaped or conformed consumer product including a personal care product such as the retractable razor assembly described above. The packaging system can define a configuration that accommodates the assembly's unique shape or conformation and displays the assembly attractively and functionally. The packaging system can be configured to permit consumers to visually inspect and to physically interact with the razor assembly while packaged. The packaging system, for instance, can be configured to permit the actuating element of the razor assembly to remain exposed and thereby accessible to consumers when the razor assembly is packaged. Consumers can freely manipulate the actuating element to witness the razor assembly's features and functions and to demonstrate its different operating states. The packaging system can be further configured to protect the razor assembly and to insure a hygienic condition.

These and other advantages of the invention, along with the invention itself, will be more fully understood after review of the following figures, detailed description, and claims.

DETAILED DESCRIPTION OF THE PREFERRED EMBODIMENTS

At least some embodiments of the invention include a retractable razor assembly constructed and arranged to fold and to retract a blade support assembly within a handle for storage. The razor assembly according to the invention includes the blade support assembly constructed and arranged to mount and to stabilize a razor blade or cartridge and to thereby promote and insure comfort and safety during use of the razor assembly. At least some embodiments of the invention include a packaging system designed and configured to display a consumer product and to securely contain the product for display, as well as for transport and storage. The packaging system according to the invention includes a configuration that accommodates a shape or a conformation of a product and permits access to the product when the product is disposed in the packaging system, thereby allowing consumer interaction with the packaged product. At least some embodiments of the invention include a combination of the razor assembly and the packaging system to easily, economically and attractively display and demonstrate features and functions of the razor assembly and to market the razor assembly to consumers. Other embodiments are within the scope of the invention.

Figure 1:
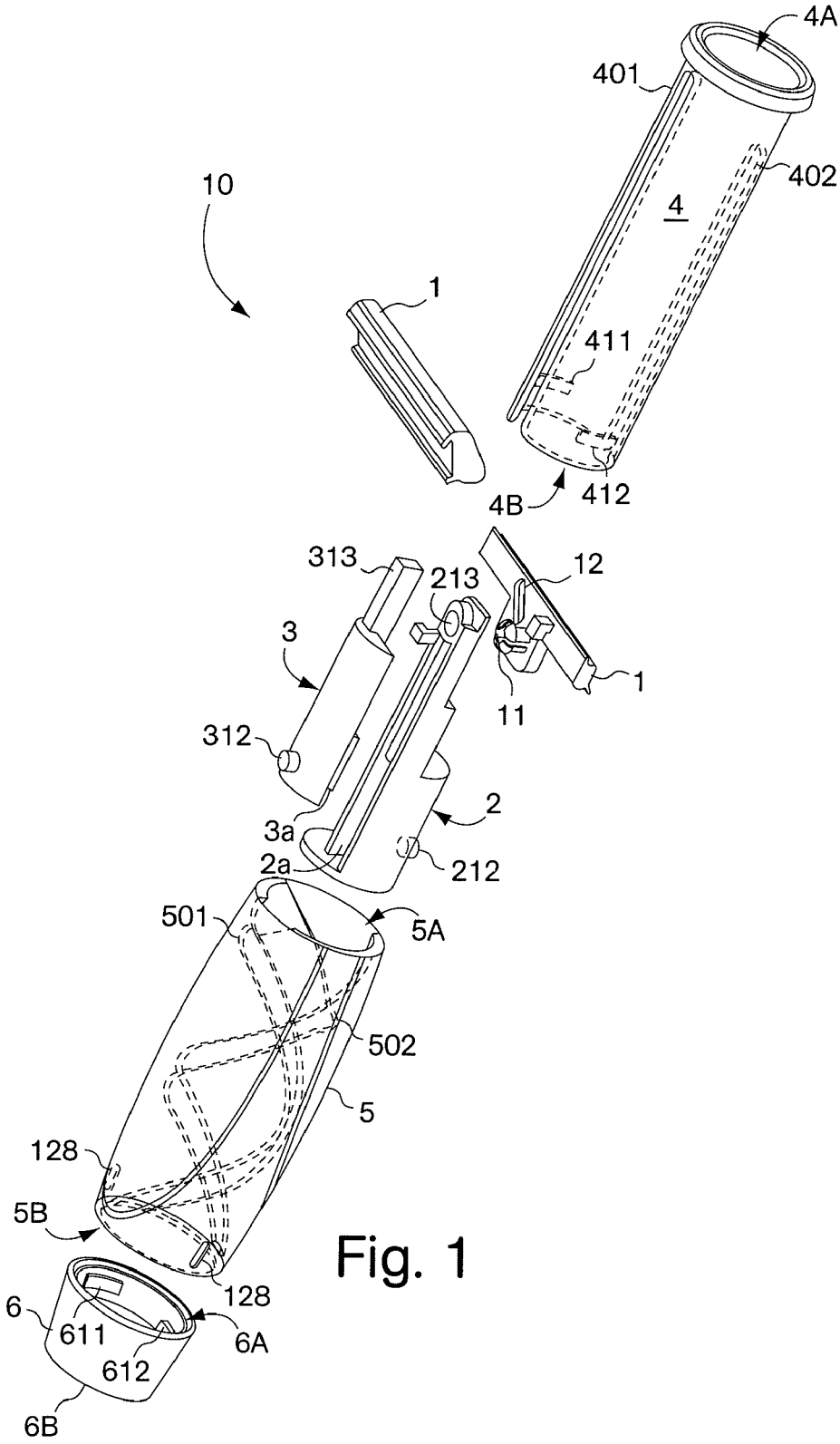
FIG. 1 is an exploded perspective view of a razor assembly according to one, embodiment of the invention.
Figure 2:
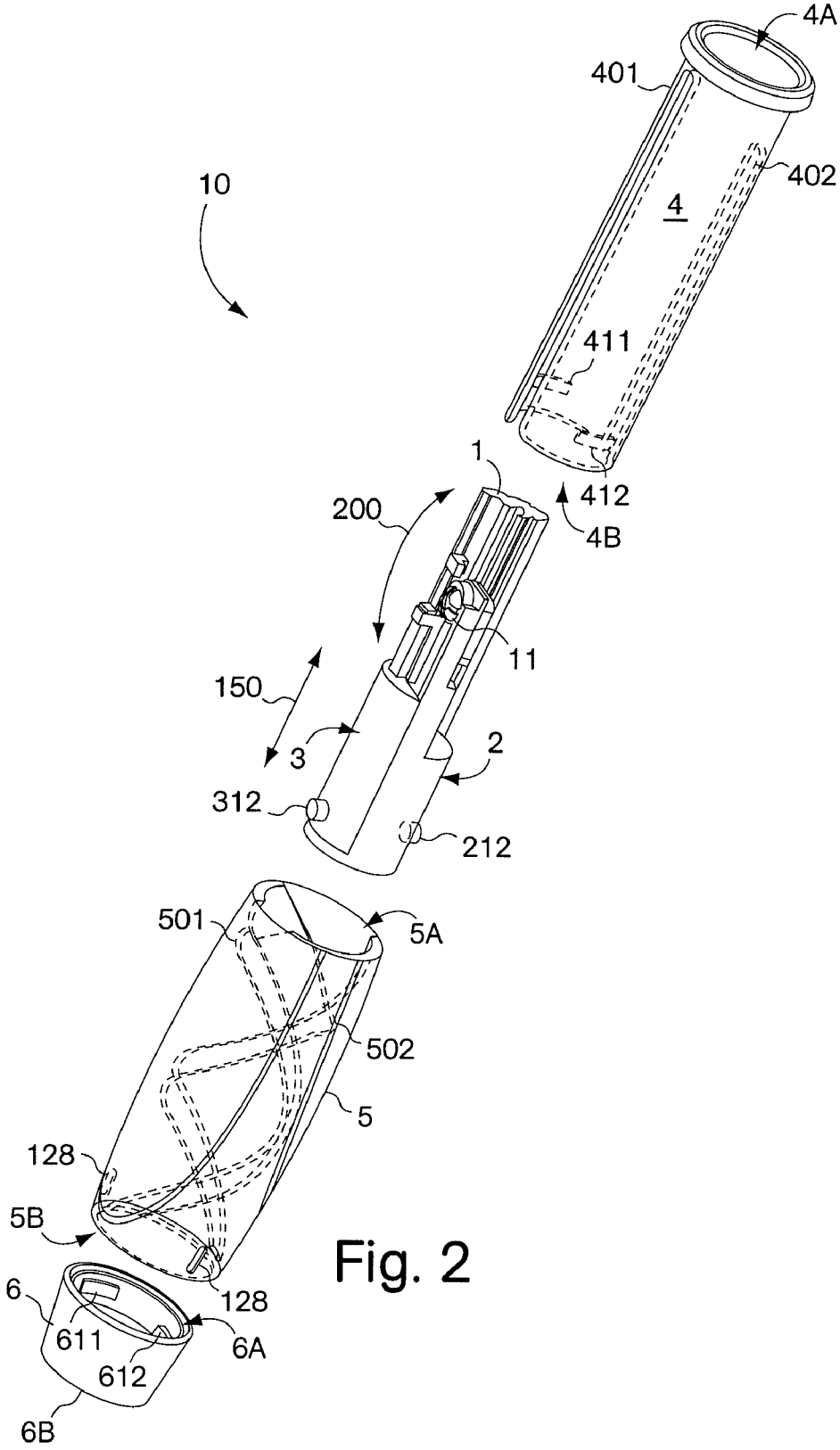
FIG. 2 is an exploded perspective view of the razor assembly shown in FIG. 1 with a blade support and a blade adjustment assembly in a retracted position in one embodiment of the invention.

Referring to FIGS. 1-2, the invention provides a razor assembly (10) including a retractable and foldable blade support assembly having a blade support (1) and a blade mounting assembly (2 and 3). The razor assembly (10) further includes a handle assembly (4 and 5) and an actuating element (6). The blade support (1) has a first surface or a front portion structured and arranged to receive and to hold one of a razor blade and a razor cartridge, e.g., as is commercially available. A second surface or a rear portion of the blade support (1), opposite to the first surface or the front portion, is straightened and arranged to define or has disposed thereon a fixing stem (11). The fixing stem (11) is configured to fit with or insert into an opening (213) defined in the blade mounting assembly (2 and 3) to connect the blade support (1) to the assembly (2 and 3). In one embodiment, the fixing stem (11) is sized and configured such that the opening (213) receives the fixing stem (11) to securely connect the blade support (1) to the blade mounting assembly (2 and 3).

In one embodiment, the fixing stem (11) and the opening (213) are constructed and arranged to operatively couple the blade support (1) to the blade mounting assembly (2 and 3) such that the blade support (1) is movable and pivots about the fixing stem (11). The blade support (1) thereby can move from a first or "open" position, where the blade support (1) is oriented substantially perpendicular to the blade mounting assembly (2 and 3), to a second or "closed" position, where the blade support (1) is oriented substantially adjacent to the blade mounting assembly (2 and 3) and substantially vertical relative to the razor assembly (10). In one embodiment, movement of the blade support (1) from the first to the second position and from the second to the first position is limited to the blade support (1) pivoting about 90 degrees, as shown by arrow (200) in FIG. 2.

In one embodiment, the fixing stem (11) is configured to fit with or insert into the opening (213) defined in a first mounting element (2) to securely connect the blade support (1) to the blade mounting assembly (2 and 3). Connecting the fixing stem (11) to the opening (213) of the first mounting element (2) helps to provide a stable support for a razor blade or cartridge. In one embodiment, the first mounting element (2) is configured and sized such that it is the larger mounting element of the two mounting elements (2 and 3) comprising the blade mounting assembly (2 and 3). The configuration, size and/or position of the first mounting element (2) helps to provide a stable support for the blade support (1) and a blade or cartridge mounted thereon. The first mounting element (2) has a size and a weight that adds mass to the razor assembly (10) to thereby help to further stability of the blade support. In addition, connecting the blade support (1) to the first mounting element (2) helps to ensure that the blade support (1) remains in a substantially fixed or stationary position, e.g., does not move, shift or tilt about the blade mounting assembly (2 and 3), when the blade support (1) is in the open position and during use of the razor assembly (10). The invention is not limited to the combination of the fixing stem (11) and the opening (213) as described to movably or pivotally connect the blade support (1) to the blade mounting assembly (2 and 3) and anticipates other configurations and arrangements that permit the blade support (1) to be securely and movably or rotatably connected to one of the mounting elements (2 and 3).

The blade support (1) further includes a guide slot (12) disposed and configured to engage a protrusion (313) located on one of the mounting elements of the blade mounting assembly (2 and 3). In one embodiment, the guide slot (12) is defined in the second surface or rear portion of the blade support (1) and the protrusion (313) is defined in the second mounting element (3) of the blade mounting assembly (2 and 3). The guide slot (12) is disposed and configured to receive the protrusion (313) and to permit the protrusion (313) to slide or glide along the guide slot (12). During extension and retraction of the blade mounting assembly (2 and 3), the protrusion (313) slides along the guide slot (12) to permit the blade support (1) to shift or pivot from the first to the second position and from the second to the first position, as described below in further detail.

Referring further to FIGS. 1-2, the blade mounting assembly (2 and 3) includes the first mounting element (2) and the second mounting element (3). The second mounting element (3) is adapted or configured to move relative to the first mounting element (2) as the blade support (1) is extended or retracted. The first mounting element (2) can be operatively fitted with or coupled to the second mounting element (3) by a "tongue and groove" configuration and arrangement to facilitate movement of the second mounting element (3) relative to the first mounting element (2). In one embodiment, the tongue and groove configuration includes a groove (2*a*) defined in the first mounting element (2) and configured to receive a tongue (3*a*) defined in the second mounting element (3) such that the groove and tongue mate and allow the first and the second mounting elements (2 and 3) to couple. When the first and the second mounting elements (2 and 3) are coupled, the groove and tongue combination enables the second mounting element (3) to slide along the groove to enable the second mounting element (3) to move against the first mounting element (2), as shown by arrow (150) in FIG. 2, to thereby either extend or contract the blade mounting assembly (2 and 3).

Each of the first and the second mounting elements (2 and 3) can include a protruding stem (212 and 312) disposed at a lower portion of the respective element (2 and 3). Each protruding stem (212 and 312) can be disposed and configured to fit into one of two spiral guide paths (501 and 502) defined in an interior surface of an outer cylinder (5) of the handle assembly (4 and 5), as described below in further detail. In one embodiment, the spiral guide paths (501 and 502) can have different lengths. In one embodiment, a first spiral guide path (501) can be longer than a second spiral guide path (502) and can be disposed and configured to receive the protruding stem (312) of the second mounting element (3). The second spiral guide path (502) can be disposed and configured to receive the protruding stem (212) of the first mounting element (2).

The handle assembly (4 and 5) can include the outer cylinder (5) disposed and configured to receive an inner cylinder (4). In one embodiment, the outer cylinder (5) can be a hollow cylindrical member having a first open end (5A) and a second open end (5B). In one embodiment, the outer cylinder (5) can have an inner surface that defines a substantially circular cross-section, while an outer surface of the cylinder (5) defines a substantially convex shape or outer profile. The inner cylinder (4) can be a hollow cylindrical member having a first open end (4A) and a second open end (4B). In one embodiment, the inner cylinder (4) defines a substantially circular cross-section. The outer cylinder (5) can be sized and configured to receive the inner cylinder (4). The inner cylinder (4) can be sized and configured such that the second open end (4B) of the inner cylinder (4) can be inserted into the first open end (5A) of the outer cylinder (5).

The inner cylinder (4) can have one or more protruding tabs (411 and 412) configured in its outer surface along a lower portion of the inner cylinder (4), adjacent to the second terminal end (4B). The two tabs (411 and 412) can be diametrically defined in the outer surface on opposite sides of the inner cylinder (4). Alternatively, two tabs (411 and 412) can be asymmetrically arranged on the inner cylinder (4). The tabs (411 and 412) can be disposed and configured to fit into one or more notches (611 and 612) defined in an interior surface of the actuating element (6) to thereby connect the inner cylinder (4) with the actuating element (6). In one embodiment, the notches (611 and 612) are diametrically defined in opposite sides of the inner surface.

In one embodiment, the two protruding tabs (411 and 412) and the two notches (611 and 612) can be disposed and configured such that, where the inner cylinder (4) is inserted into the actuating element (6), one of the notches (611 and 612) receives and mates with one of the protruding tabs (411 and 412) to securely join or connect the inner cylinder (4) to the actuating element (6). In one embodiment, the protruding tabs (411 and 412) and the notches can be disposed and configured to permanently connect the inner cylinder (4) to the actuating element (6).

The actuating element (6) can include a member having a first open terminal end (6A) and a second opposite closed terminal end (6B). In one embodiment, the actuating element (6) can be constructed as a single unit. In one embodiment, the second closed terminal end (6B) has a substantially flat outer surface such that the flat terminal end (6B) permits the razor assembly (10), when assembled, to stand upright on a substantially planar surface. Where the inner cylinder (4) is inserted into the outer cylinder (5) and connected to the actuating element (6), the actuating element (6) is disposed and configured to rotate the inner cylinder (4) within the outer cylinder (5). The outer cylinder (5) can be held stationary, e.g., by a user manually holding or gripping the outer cylinder (5), and the actuating element (6) can be turned or rotated. As described below in further detail, the movement or rotation of the actuating element (6) extends and retracts the blade mounting assembly (2 and 3) from the handle assembly (4 and 5).

In one embodiment, the actuating element (6) has sufficient weight to help add mass and weight to an overall configuration of the razor assembly (10). In addition, the mass or weight of the actuating element (6) can help to provide a secure and stable fit between the actuating element (6) and the inner cylinder (4), and thereby help to support and stabilize the blade mounting assembly (2 and 3) and the blade support (1) during use of the razor assembly.

Figure 6:
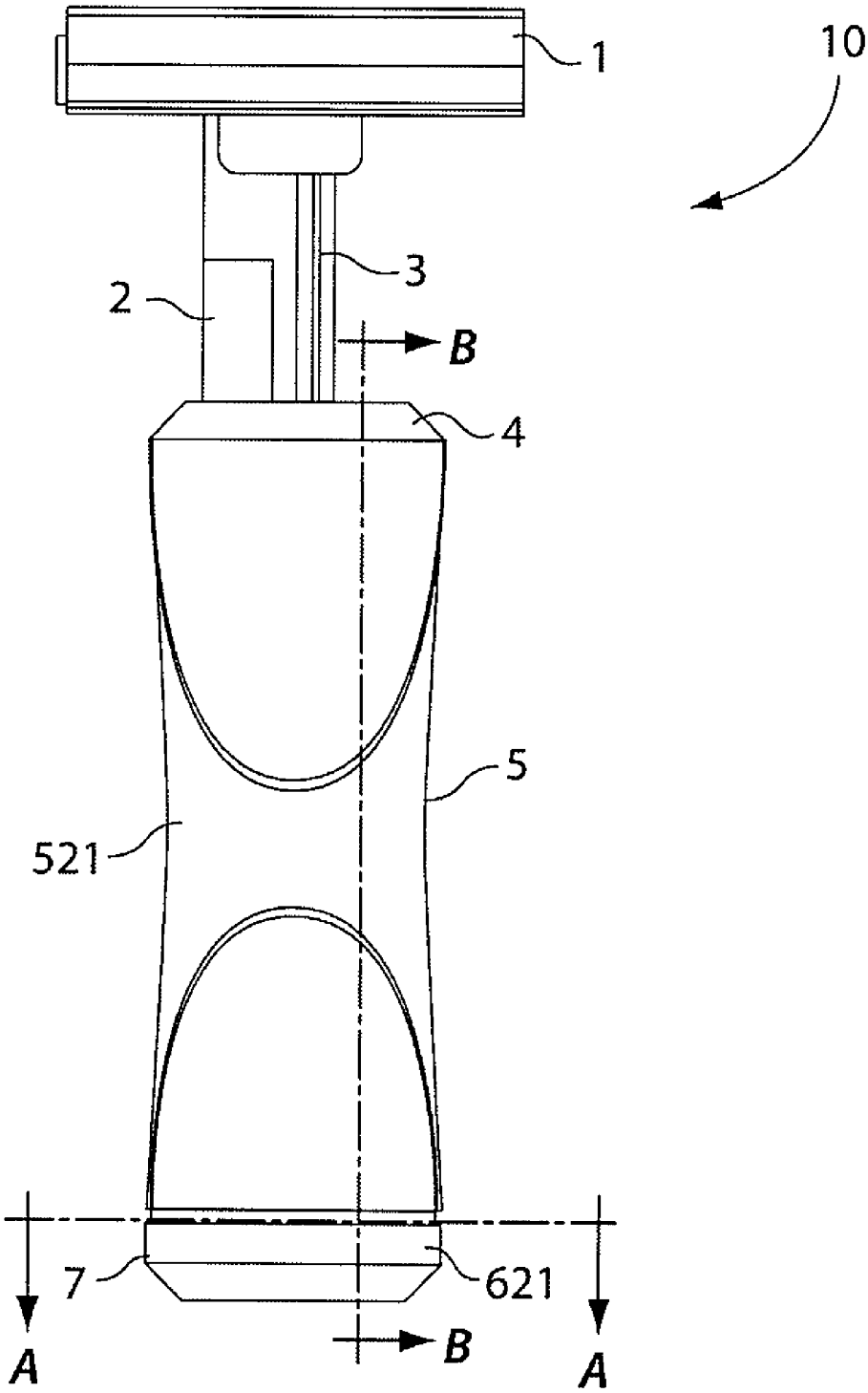
FIG. 6 is a front view of the razor assembly shown in FIG. 5 having a concave shaped outer cylinder of the handle assembly.
Figure 6A:
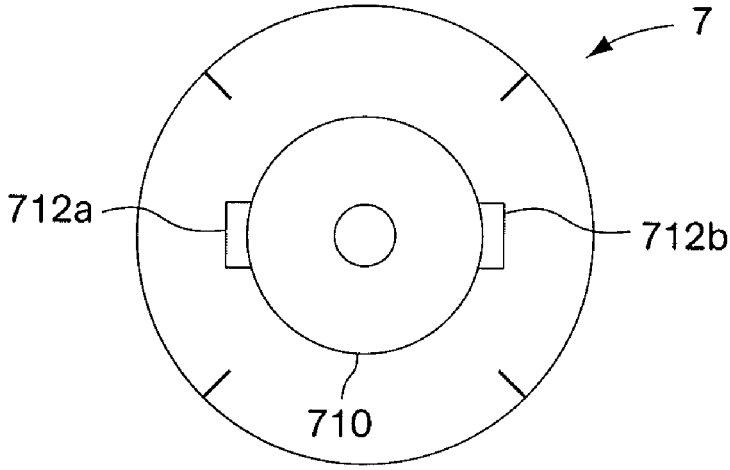
FIG. 6A is a top view of an actuating element of the razor assembly shown in FIG. 6.
Figure 6B:
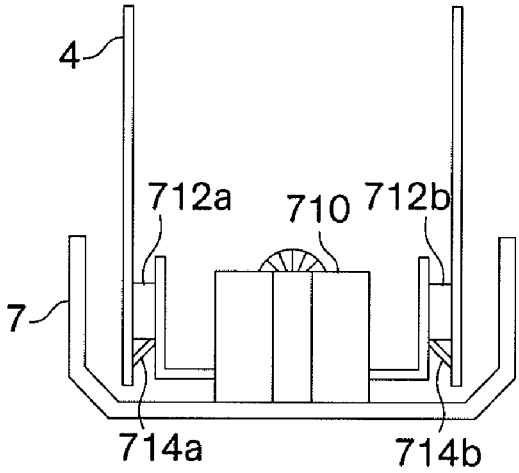
FIG. 6B is a cross sectional side view of the actuating element shown in FIG. 6A coupled with an inner cylinder of the razor assembly shown in FIG. 6.

Referring to FIGS. 6-6B, in one embodiment of the razor assembly (10), the outer cylinder (5) can define a concave shape or outer profile. In this case, the outer cylinder (5) and the inner cylinder (4) can be configured to accept an actuating element (7) having a design and configuration to permit the actuating element (7) to connect and/or to mate with the concave handle (5) and the inner cylinder (4). As shown in FIG. 6A, a top view of the actuating element (7), the actuating element (7) can include a center mounting portion (710) having a circular cross section and can be sized to permit the inner cylinder (4) to receive and to fit to or mate with the center mounting portion (710). The center mounting portion (710) can include along an outer perimeter surface one or more mounting tabs (712) to mate with the inner cylinder (4) to connect the actuating element (7) to the inner cylinder (4). In one embodiment, the mounting portion (710) defines two mounting tabs (712) diametrically disposed on opposite sides of the mounting portion (710). In one embodiment, the two mounting tabs (712) can have different sizes in one or more dimensions thereof, for example, a first (712*a*) tab being larger than a second tab (712*b*).

As shown in FIG. 6B, the inner cylinder (4) can define in an inner surface along a lower portion of the cylinder (4) one or more protrusions (714). In one embodiment, the cylinder (4) can define two protrusions (714) diametrically disposed on opposite sides of the cylinder (4). The mounting tabs (712) of the mounting portion (710) and the protrusions (714) of the inner cylinder (4) can be disposed and configured to permit the tabs (712) and the protrusions (714) to mate. When the inner cylinder (4) receives the mounting portion (710), the protrusions (714) can slide over the mounting tabs (712) and mate with the mounting tabs (712). The protrusions (714) can be configured such that when the protrusions (714) mate with the mounting tabs (712), the protrusions (714) bias upward against the mounting tabs (712) to securely connect the actuating element (700) to the inner cylinder (4) and the outer cylinder (5). In one embodiment, the protrusions (714) can have different sizes (in one or more dimensions) to accommodate a size of the respective tab (712) to which each protrusion mates (714). As shown in FIG. 6B, a first protrusion (714*a*) can be sized to mate with the first and larger tab (712*a*), and a second protrusion (714*b*) can be sized to mate with the second and smaller tab (7.12*b*). The different sizes of the tabs (712) and the protrusions (714) can help to insure a secure connection between the inner and outer cylinders (4 and 5) and the actuating element (7), and to insure easy and quick assembly of the razor (100).

The invention is not limited to the actuating element (6) described with reference to FIGS. 1-2 and the actuating element (7) described with reference to FIGS. 6-6B, and includes other configurations and arrangements to connect the inner and outer cylinders (4 and 5) to an actuating element.

Again referring to FIGS. 1-2, the inner cylinder (4) defines one or more vertical slots (401 and 402). In one embodiment, the inner cylinder (4) defines two vertical slots (401 and 402) diametrically disposed on opposite sides of the cylinder (4). Each slot (401 and 402) extends longitudinally along a length of the inner cylinder (4). In one embodiment, the vertical slots (401 and 402) can have substantially similar heights and extend longitudinally along about an equal length of the inner cylinder (4). In another embodiment, the vertical slots (401 and 402) can have different heights, extending longitudinally at unequal lengths along the inner cylinder (4 and 5).

In one embodiment, the inner cylinder (4) defines the vertical slots (401 and 402) asymmetrically on opposite sites of the cylinder (4). The asymmetry of the vertical slots (401 and 402) can help to provide resistance and stability to actuating the mounting elements (2 and 3) when the elements (2 and 3) are extended from and retracted into the inner cylinder (4).

Each vertical slot (401 and 402) can be disposed and configured to receive a protruding stem (212 and 312) defined on the blade adjustment assembly (2 and 3) when the razor assembly (10) is formed. As noted above, the blade mounting assembly (2 and 3) can include the first protruding stem (212) disposed on the first mounting element (2) and the second protruding stem (312) disposed on the second mounting element (3). Each of the first and the second protruding stems (212 and 312) can be located on its respective mounting element (2 and 3) at a different height. In one embodiment, when the elements (2 and 3) are coupled, the first protruding stem (212) is disposed above or higher than the second protruding stem.

During extension and contraction of the blade mounting assembly (2 and 3), the protruding stems (212 and 312) engage the vertical slots (401 and 402). The vertical slots (401 and 402) help to stabilize and to guide the protruding stems (212 and 312) as the protruding stems (212 and 312) move along the spiral guide paths (511 and 512) of the outer cylinder (5). As described below in further detail, when the actuating element (6) rotates, the inner cylinder (4 and 5) similarly rotates within the outer cylinder (5) and the protruding stems of the blade mounting assembly (2 and 3) slide along the guide slots and through the vertical slots (401 and 402), either in a direction for extension or a direction for retraction of the razor assembly (10).

In one embodiment, the vertical slots (401 and 402) can have different widths and the protruding stems (212 and 312) defined in the first and the second mounting elements (2 and 3) can have different sizes. In this case, a first vertical slot (402) can have a width sized to receive only the protruding stem (212) on the first mounting element (2) and a second vertical slot (402) can define a width sized to receive only the protruding stem (312) on the second mounting element (3). Different widths of the vertical slots (401 and 402) and different sizes of the protruding stems (212 and 312) can help to insure quick and accurate assembly of the razor (10).

As noted above, the outer cylinder (5) includes one or more spiral guide paths (501 and 502) defined in an inner surface of the cylinder (5). Each of the spiral guide paths (501 and 502) extends from a bottom portion of the outer cylinder (5) upward in a spiral orientation/configuration to a top portion of the outer cylinder (5). The spiral guide paths (501 and 502) are disposed and configured to receive the protruding stems (212 and 312) of the first and the second mounting elements (2 and 3). When the actuating element (6) rotates and similarly rotates the inner cylinder (4) and the first and the second mounting elements (2 and 3) disposed therein, the protruding stems (212 and 312) slide along the guide slots (501 and 502), to extend or to retract the blade mounting assembly (2 and 3).

Figure 2A:
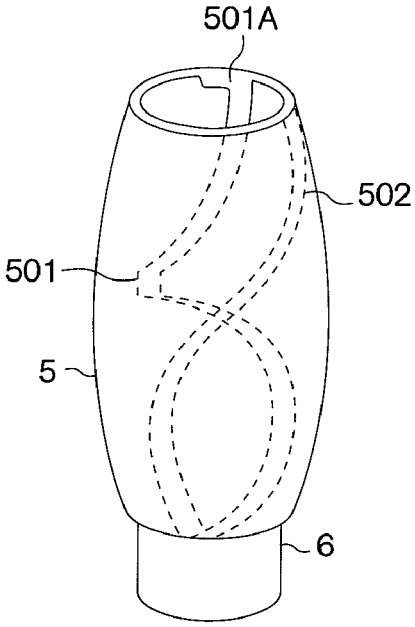
FIG. 2A is a cross-sectional perspective of an outer cylinder of the razor assembly shown in FIG. 1 illustrating a detent defined in an inner surface of the cylinder in one embodiment of the invention.

Referring to FIG. 2A, and with further reference to FIGS. 1-2, in one embodiment, one of the two guide paths (501 and 502), e.g., the guide path that accepts the protruding stem (212) of the first mounting element (2), terminates to a detent (501A). The detent (501A) is defined in the inner surface of the upper portion of the outer cylinder (5), and is disposed and configured to receive the protruding stem (212) as the stem (212) reaches the top of one of the spiral guide paths (501 and 502). The detent (501A) is configured to mate with the protruding stem (212 and 312). In one embodiment, disposed in the detent (501A), the protruding stem (212) is biased against the detent (501A), which helps to provide resistance against movement of the protruding stem (212) in the detent (501A). The detent (501A) thereby helps to ensure that the blade mounting assembly (2 and 3) remains stable and in a stationary position when extended from the handle assembly (4 and 5). The bias provided by the detent (501A) can be overcome with sufficient manual pressure to dislodge the protruding stem (212 and 312) from the detent (501A) to contract or retract the blade mounting assembly (2 and 3).

With further reference to FIGS. 1-2, the razor assembly (10) can be assembled by connecting the blade support (1) to the blade mounting assembly (2 and 3). The fixing stem (11) of the blade support (1) can be inserted into the opening (213) defined in the first mounting element (2) to securely and movably connect the blade support (1) to the blade mounting assembly (2 and 3). The fixing stem (11) and the opening (213) combination permit the blade support (1) to move or pivot from the first or "open" position, as schematically illustrated in FIG. 1, to the second or "folded" position, as shown in FIG. 2.

Figure 3:
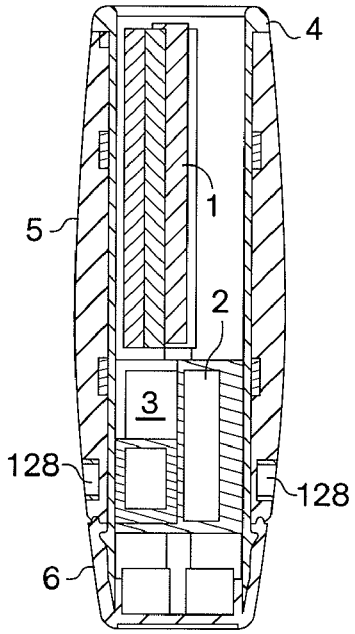
FIG. 3 is a cross-sectional side view of the blade support and the blade adjustment assembly disposed in a handle assembly of the razor assembly shown in FIG. 1.
Figure 4:
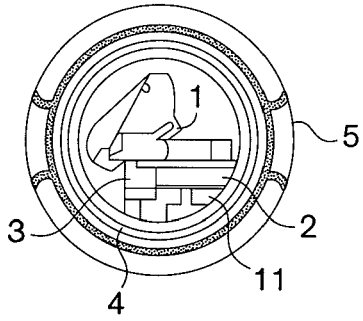
FIG. 4 is a top view of the razor assembly shown in FIG. 1 with the assembled blade support and the blade adjustment assembly disposed within a handle assembly.

Referring to FIGS. 3-4, and with further reference to FIG. 2, further assembly of the razor assembly (10) can include positioning and coupling the blade mounting assembly (2 and 3) and the blade support (1) attached thereto with the inner cylinder (4). The blade mounting assembly (2 and 3) and the blade support (1) can be configured and sized such that the inner cylinder (4) receives the blade mounting assembly (2 and 3) and the blade support (1). Each protruding stem (212 and 312) of the mounting elements (2 and 3) is inserted into one of the vertical slots (401 and 402) of the inner cylinder (4) such that the blade support (1) and blade mounting assembly (2 and 3) are disposed within the inner cylinder (4). The outer cylinder (5) can receive the inner cylinder (4) by inserting each protruding stem (212 and 312) of each mounting element (2 and 3) into an upper portion of one of the spiral guide paths (501 and 502). Each path (501 and 502) receives the protruding stem (212 and 312) and helps to facilitate insertion of the inner cylinder into the outer cylinder (5). The inner cylinder (4) can then be connected to the actuating element (6) by mating the tabs (411 and 412) to the notches (611 and 612).

As shown in FIG. 3, when the razor assembly (10) is formed, the outer cylinder (5) contains the inner cylinder (4), and the blade support (1) and the blade mounting assembly (2 and 3) can be in the second or folded position. The first and the second mounting elements (2 and 3) are substantially contracted wherein the second element (3) is in a retracted position relative to the first element (2), as shown in FIG. 3. The outer and the inner cylinders (4 and 5) define an interior configured and sized to contain the blade support (1) and the blade mounting assembly (2 and 3) and to permit movement of the second element (3) against the first element (2) to thereby extend and retract the blade assembly (2 and 3) and the blade support (1) into and from the handle assembly (4 and 5)

With further reference to FIGS. 1-4, operation of the razor assembly (10) is described. The blade support (I) is in the second or folded position when the mounting elements (2 and 3) are contracted and the blade support (1) and the blade mounting assembly (2 and 3) are retracted into the handle assembly (4 and 5). Where use of the assembly (10) is desired, the actuating element (6) can be turned or rotated, while the outer cylinder (5) remains stationary, e.g., by manually holding the cylinder (5). The turning or rotating action of the actuating element (6) can cause the inner cylinder (4) and the blade mounting assembly (2 and 3) to similarly turn or rotate and the protruding stems (212 and 312) to slide vertically upward or longitudinally along the spiral guide paths (501 and 502) of the outer cylinder (5). As the actuating element (6) continues to rotate, the blade mounting assembly (2 and 3) rotates continuously and moves vertically upward or longitudinally along the inner cylinder (4), and the protruding stems (212 and 312) glide or move along the spiral guide paths (501 and 502) of the outer cylinder (5). The protruding stems (212 and 312) simultaneously slide or glide upward or longitudinally along the vertical slots (401 and 402). As noted above, the vertical slots (401 and 402) help to stabilize and help to guide the mounting elements (2 and 3) as the blade mounting assembly (2 and 3) rotates.

The spiral guide paths (501 and 502) can be disposed and configured to permit each of the mounting elements (2 and 3) to extend from the handle assembly (4 and 5) independently. When the blade support (1) emerges from the handle assembly (4 and 5), the blade mounting assembly (2 and 3) continues to rotate and to move continuously upward or longitudinally along the inner cylinder (4). When the blade mounting assembly (2 and 3) emerges from the handle assembly (4 and 5), each mounting element (2 and 3) extends from the handle assembly (4 and 5) independently by the rotating action of the actuating element (6). The first mounting element (2), the larger of the two mounting elements, can complete its extension first. The second mounting element (3) can continue to extend by sliding or moving against the first mounting element (2) as can be provided by the tongue and groove (2*a* and 3*a*) combination. As the second mounting element (3) continues to extend, the protrusion (313) of the second mounting element (3) can slide along the guide slot (12) of the blade support (1). The movement of the second mounting element (3) along the guide slot (12) can cause the blade support (1) to move from the second or folded position to the first or open position, as shown by arrow (200) in FIG. 2. The second mounting element (3) substantially pushes the blade support into the first, or open position. The second mounting element (3) substantially pushes the blade support into the first, or open position. When the second mounting element (3) is fully extended, the blade support (1) can be in the first or open position.

In the first or open position, the blade support (1) can be disposed on the blade mounting assembly (2 and 3) in a substantially fixed position, e.g., the blade support (1) does not move, tilt or shift about the blade mounting assembly (2 and 3). As described above, the fixing stem (11) connected to the first mounting element (2) ensures the blade support (1) is stable and remains in the substantially fixed position when connected to the blade mounting assembly (2 and 3).

Figure 5:
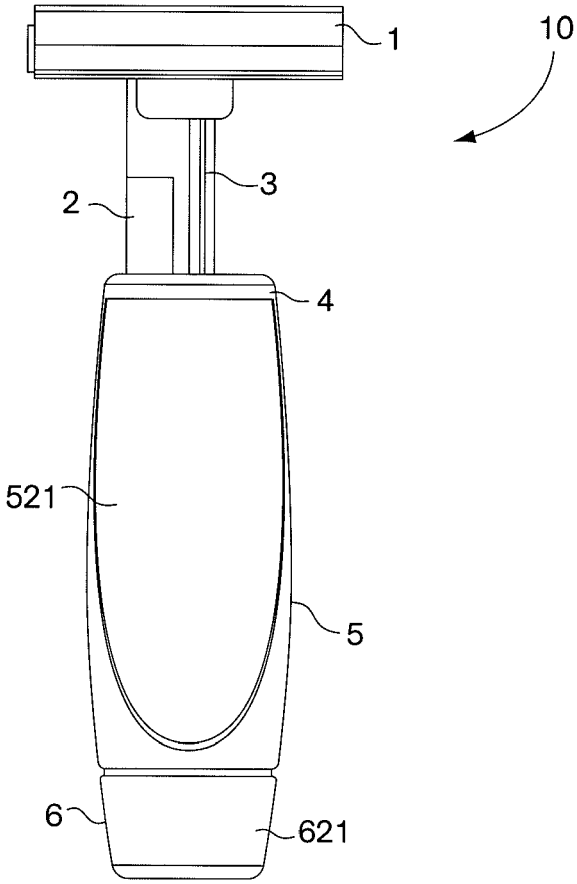
FIG. 5 is a front view of the razor assembly shown in FIG. 1 with the blade support in an open position.

Referring to FIGS. 5-6, in one embodiment, an exterior surface (521) of the outer cylinder (5) and/or an exterior surface (621) of the actuating element (6) can have a material suitable for ensuring a user can achieve and maintain a substantially secure grip when manually holding the outer cylinder (5) or the actuating element (6) during use of the razor assembly (10). A suitable material can withstand moisture and wet conditions. In one embodiment, a suitable material can withstand high temperatures and resist deformity. In one embodiment, a suitable material can include a coating of the exterior surface (521 and 621). In another embodiment, a suitable material can include a layer of material affixed or incorporated with the exterior surface (521 and 621). In another embodiment, a suitable material can include a material that provides a texturized, raised, and/or enhanced surface to facilitate secure gripping and to promote comfort during use of the assembly (10). In another embodiment, a material for providing an aesthetically pleasing color, style and/or ornamental design is suitable to cover the outer surface of the cylinder (5). A suitable material includes, but is not limited to, rubber, a synthetic rubber, a plastic, a thermoplastic polymer, a thermoplastic polymer coat, and any combinations thereof.

Referring further to FIG. 5, in one embodiment, the outer cylinder (5) of the razor assembly (10) can define a convex shape or profile. Referring further to FIG. 6, in another embodiment, the outer cylinder (5) can define a concave shape or profile. The invention is not limited to the outer cylinder (5) defining any specific shape, configuration or profile and anticipates the outer cylinder (5) can include other shapes and configurations as desired or as required by a particular use or application of the razor assembly (10). In one embodiment, the convex shape or the concave shape of the outer cylinder (5) as shown in FIGS. 5-6 is preferred because the convex or the concave shape helps to facilitate a secure grip when a user manually holds the razor assembly (10) during use and thereby helps to increase safety. The convex or the concave shape helps to promote comfort during use of the assembly (10). The convex or the concave shape can be modified, e.g. widened, narrowed or elongated, to provide different sizes and configurations of the outer cylinder (5) that are suitable for a particular user hand size. The convex or concave shape of the outer cylinder (5) helps to facilitate safety and to promote comfort thereby providing an ergonomically comfortable and safe razor assembly (10) and shaving experience. The combination of the convex or concave shaped outer cylinder (5) having a coating or covering of a suitable material thereon to facilitate a secure and comfortable manual grip helps to maximize the razor assembly (10) comfort and safety to a user during its use.

Figure 7:
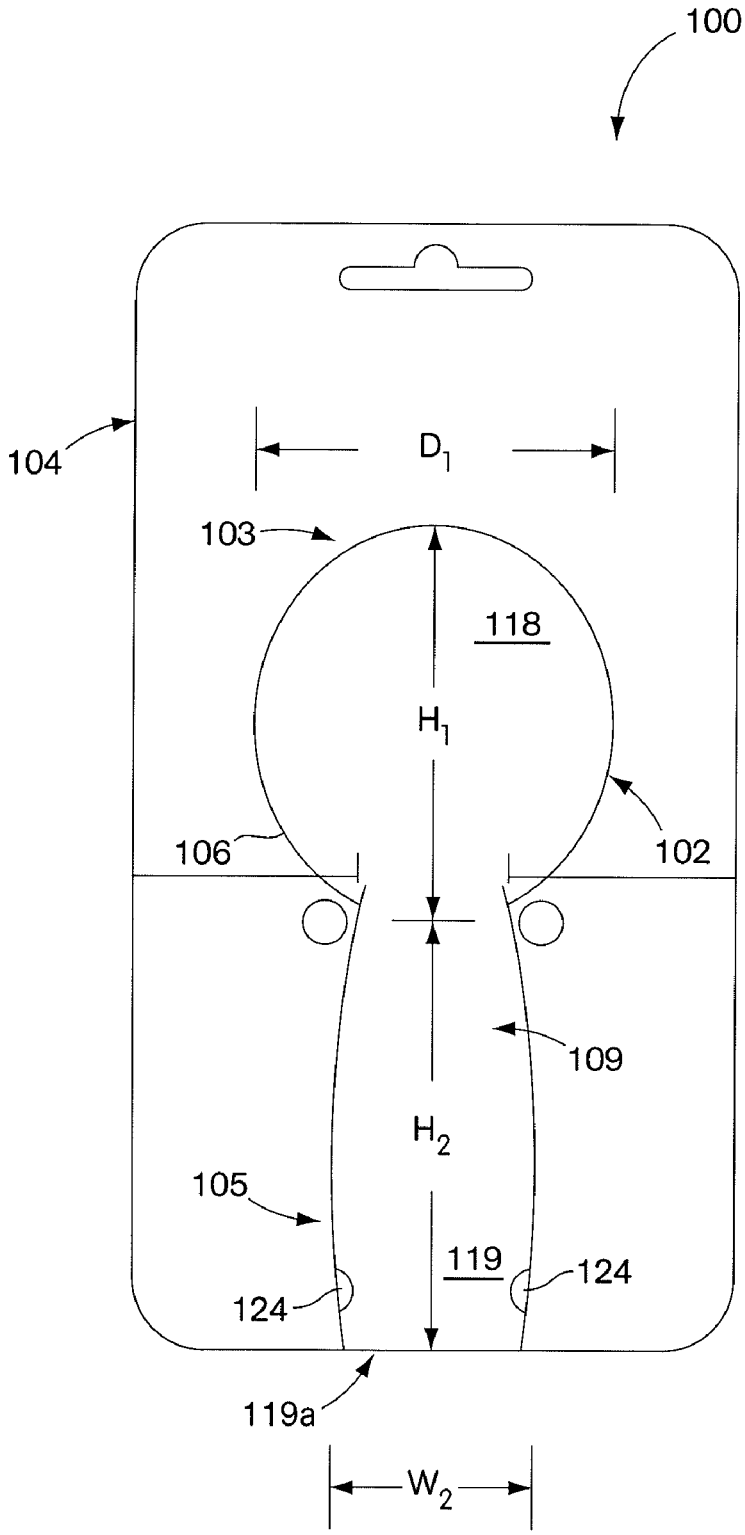
FIG. 7 is a front view of a packaging system according to one embodiment of the invention.
Figure 8:
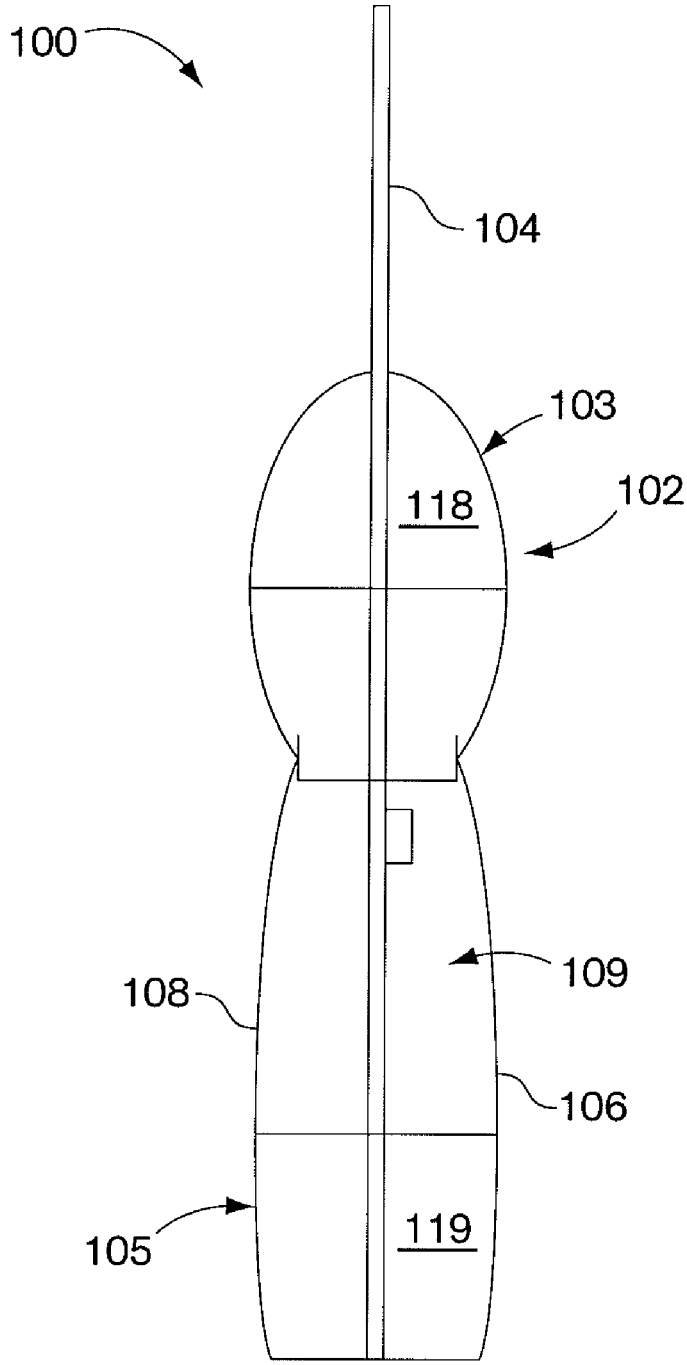
FIG. 8 is a side view of the packaging system shown in FIG. 7.

Referring to FIG. 7-8, embodiments of the razor assembly (10) can be configured to permit the razor assembly (10) to be disposed and thereby packaged in a packaging system (100) as provided according to the invention. The packaging system (100) includes a clamshell type assembly (102) and an insert card (104). The assembly (102) includes a front piece (106) and a rear piece (108), wherein each piece is configured such that the front piece (106) and the rear piece (108) can be joined or removably connected, and can separate in a manner similar to opening a clam shell; hence, the term "clamshell" type assembly (102). Where the front piece (106) and the rear piece (108) are joined or removably connected, the front piece (106) and the rear piece (108) can define an inner chamber (109).

Figure 9:
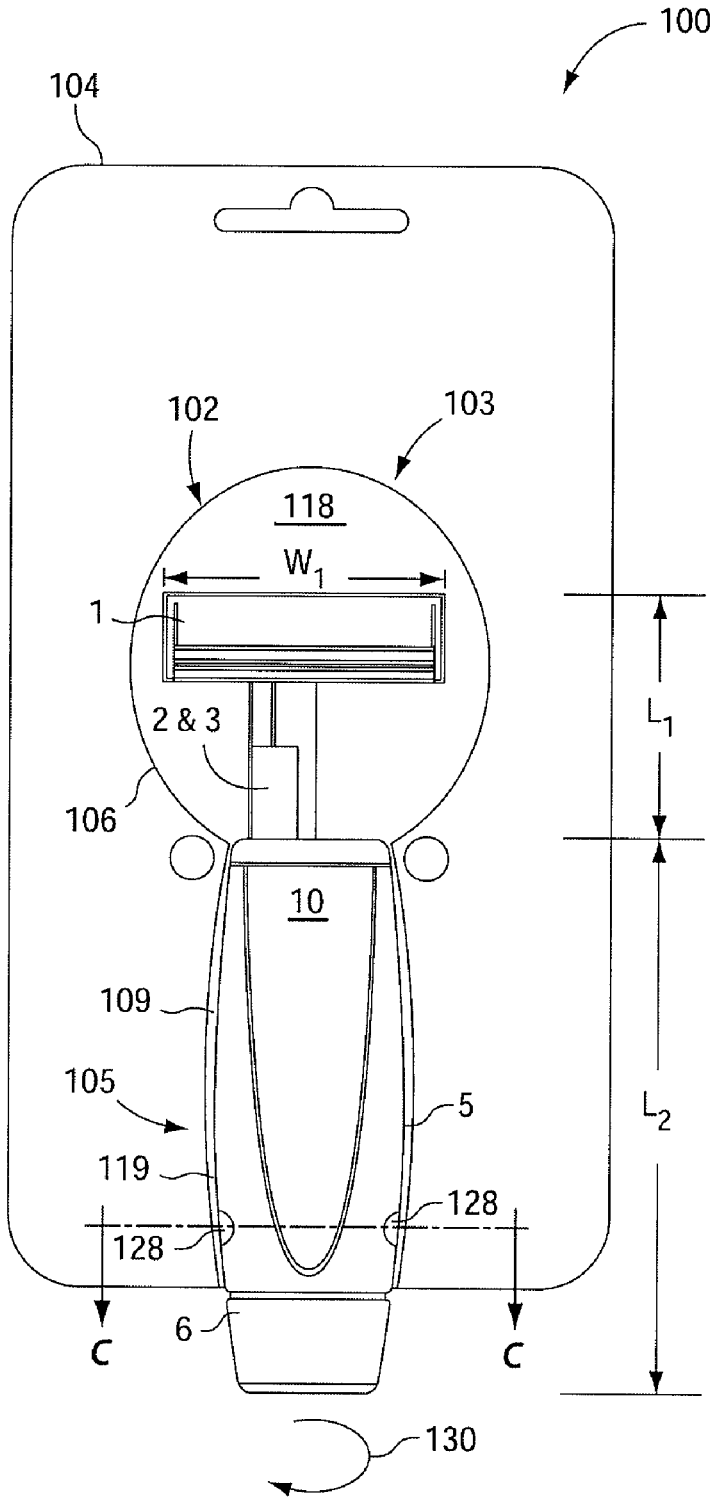
FIG. 9 is a front view of the packaging system shown in FIG. 7 with the razor assembly shown in FIG. 1 contained therein.
Figure 10:
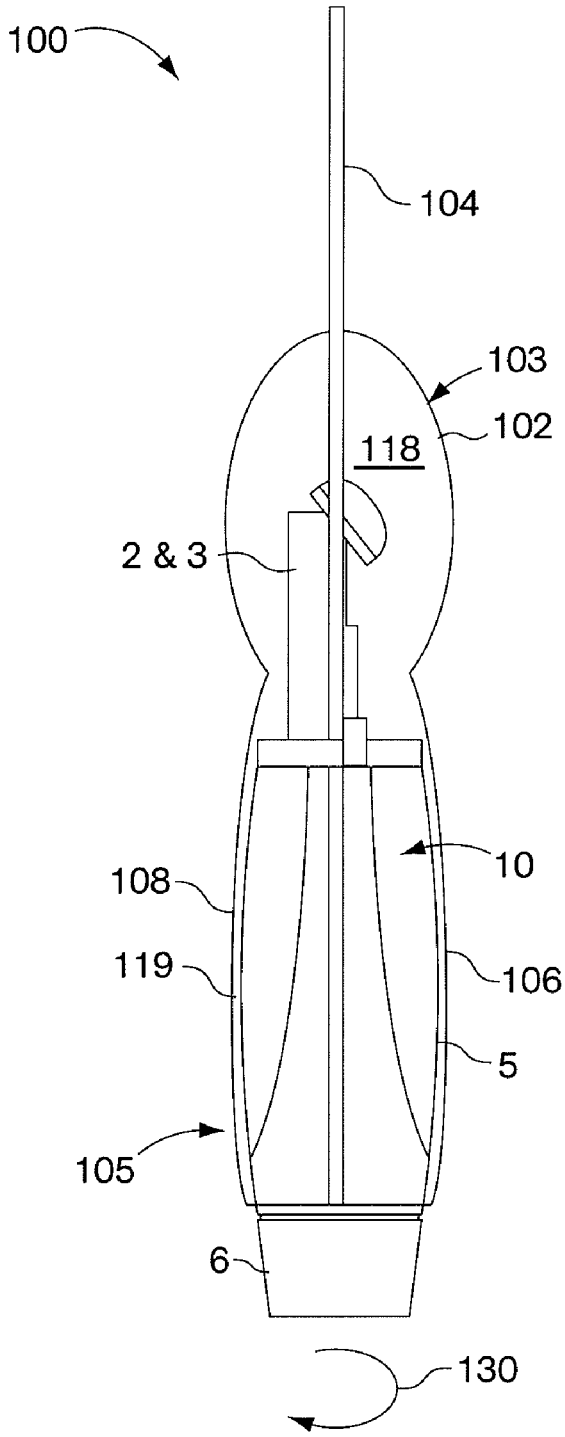
FIG. 10 is a side view of the packaging system and the razor assembly shown in FIG. 9.

Referring to FIGS. 9 and 10, and with further reference to FIGS. 7-8, in one embodiment, the front piece (106) and the rear piece (108) are configured having an internal configuration and dimensions to define the chamber (109) such that the chamber (109) includes sufficient room to provide for or accommodate a shape or outer profile of a consumer product, e.g., the razor assembly (10) as described above. In one embodiment, as shown in FIGS. 9-10, the internal configuration and dimensions of the front piece (106) and the rear piece (108) define the chamber (109) to substantially contain or surround the razor assembly (10), and thereby to dispose the razor assembly (10) in the packaging system (100).

As shown in FIGS. 7-8, in one embodiment, the front and the back piece (106) and (108) include at a distal end of the packaging system (100) a first or upper portion (103), and at a proximal end a second or lower portion (105). The upper portion (103) has a first shape and a first size such that its internal configuration defines a first or upper inner cavity (118). The lower portion (105) has a second shape and a second size such that its internal configuration defines a second or lower inner cavity (119). The upper and the lower inner cavity (118) and (119) include sufficient space to accept and contain the razor assembly (10).

In one embodiment, the first shape of the upper cavity (118) includes a spherical shape and the first size includes sufficient dimensions such that the upper cavity (118) can provide sufficient room for or accommodate the blade support (1) and the blade mounting assembly (2 and 3) of the razor assembly (10), where the assembly (10) is contained in the clamshell assembly (102). As shown in FIG. 7, in one embodiment, the upper cavity (118) has a diameter $D_1$, e.g., from about 1.75 to about 2.50 inches at its widest point, sufficient to accept and surround a width of $W_1$ of the blade support (1). Other diameters $D_1$ can be envisioned, such as a cavity having a diameter smaller than 1.75 inches or greater than 2.50 inches at its widest point. The upper portion (103) is further configured such that the upper cavity (118) has a height $H_1$, e.g., from about 1.75 to about 2.50 inches, sufficient to accept and to contain a length $L_1$ of the blade support (1) mounted to the blade adjustment assembly (2 and 3). Other heights $H_1$ of the upper cavity can be envisioned, such as a height smaller than 1.75 inches or larger than 2.50 inches. The diameter $D_1$ and the height $H_1$ of the upper portion (103) are sufficient to provide ample space within the upper cavity (118) to permit the blade support (1) and the blade mounting assembly (2 and 3) to be disposed in the packaging system (100) without contacting the upper portion (103). Thus the diameter $D_1$ and the height $H_1$ are dependent upon the size of the razor assembly (10) housed in the upper portion (103).

In one embodiment, the second shape of the lower cavity (119) includes an elongated shape and the second size includes sufficient dimensions such that the lower cavity (119) accepts and surrounds the outer cylinder (5) of the handle assembly (4 and 5) of the razor assembly (10). As shown in FIG. 7-8, in one embodiment, the lower portion (105) has a convex-shaped internal configuration such that the lower cavity (119) can accommodate a convex shape and outer profile of the outer cylinder (5) of the razor assembly (10). In one embodiment, the lower portion (105) is configured such that the lower cavity (119) has a width $W_2$, e.g., from about 0.75 to about 1.25 inches at its widest points, to accept and surround the outer cylinder (5). The lower portion (105) is further configured such that the lower cavity (119) has a length $L_2$, e.g., from about 2.25 to about 3.00 inches, to provide sufficient room for the height of the outer cylinder (5), e.g., from about 2.25 to about 3.00 inches. Other widths and lengths of the lower cavity can be envisioned.

In one embodiment, the lower portion (105) is further configured such that where the front piece (106) and the rear piece (108) are joined or removably connected, the lower portion (105) defines an opening (119*a*) at a terminal end of the lower cavity (119). When the razor assembly (10) is disposed within the assembly (102), the lower portion (105) and the opening (119*a*) are configured to permit the actuating element (6) of the razor assembly (10) to extend from the lower cavity (119). The actuating element (6) of the razor assembly (10) essentially protrudes from the lower portion (105) of the clamshell assembly (102) such that the actuating element (6) is accessible and can be manipulated.

Figure 9A:
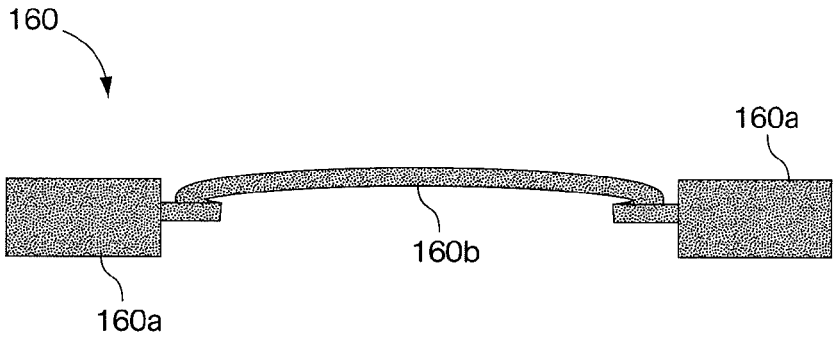
FIG. 9A is a front view of a clasp for disposing the razor assembly shown in FIG. 1 in the packaging system shown in FIG. 7.
Figure 9B:
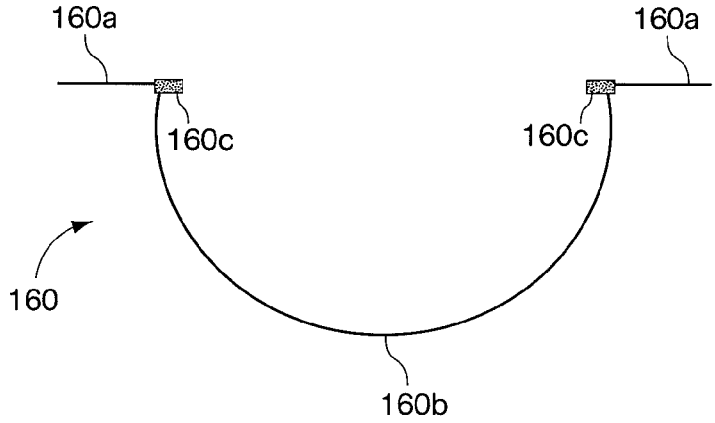
FIG. 9B is a top view of the clasp shown in FIG. 9A.
Figure 9C:
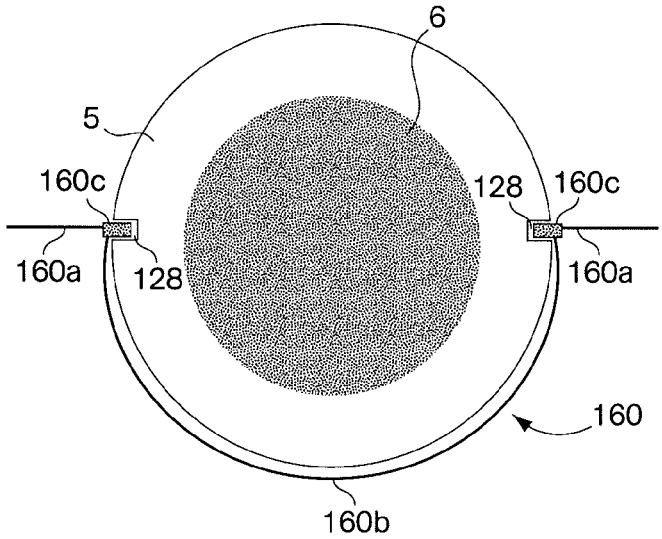
FIG. 9C is a top view of a cross section of a cylinder of a handle assembly of the razor assembly shown in FIG. 1 with the clasp shown in FIGS. 9A-9B attached.

Referring to FIGS. 9A-9C, and referring further to FIG. 9, the packaging system (100) further includes a removable clasp (160) configured to couple to and mate with an outer surface of the outer cylinder (5), and to securely mount the razor assembly (10) in the system (100). As shown in FIGS. 9A-9B, the clasp (160) includes a shaped member (160*b*) configured to conform to a shape or outer profile of the outer cylinder (5). The clasp (160) is further configured to terminate at each end into a tab (160*a*). Each tab (160*a*) is configured for insertion into a slot or recess (128) defined, e.g., engraved, in an outer surface of the outer cylinder (5), as shown in FIG. 9. In one embodiment, the clasp (160) defines two tabs (160*a*) terminating at opposites sides of the shaped member (160*b*).

Referring also to FIG. 9C, each tab (160*a*) includes a mounting portion (160*c*) configured and sized such that the recess (128) of the cylinder (5) receives the mounting portion (160*c*) to connect the clasp (160) to the cylinder (5). In one embodiment, two recesses (128) can be defined in the outer surface of the cylinder (5) and disposed on opposite sides of the cylinder (5). The clasp (160) mounts to the outer surface of the cylinder (5) by mating the shaped member (160*b*) to the outer surface, aligning each mounting portion (160*c*) with a corresponding recess (128), and inserting each mounting portion (160*c*) into its respective recess (128). The clasp (160) can have a size sufficient to bias the shaped member (160*a*) against the surface of the cylinder (5).

Figure 9D:
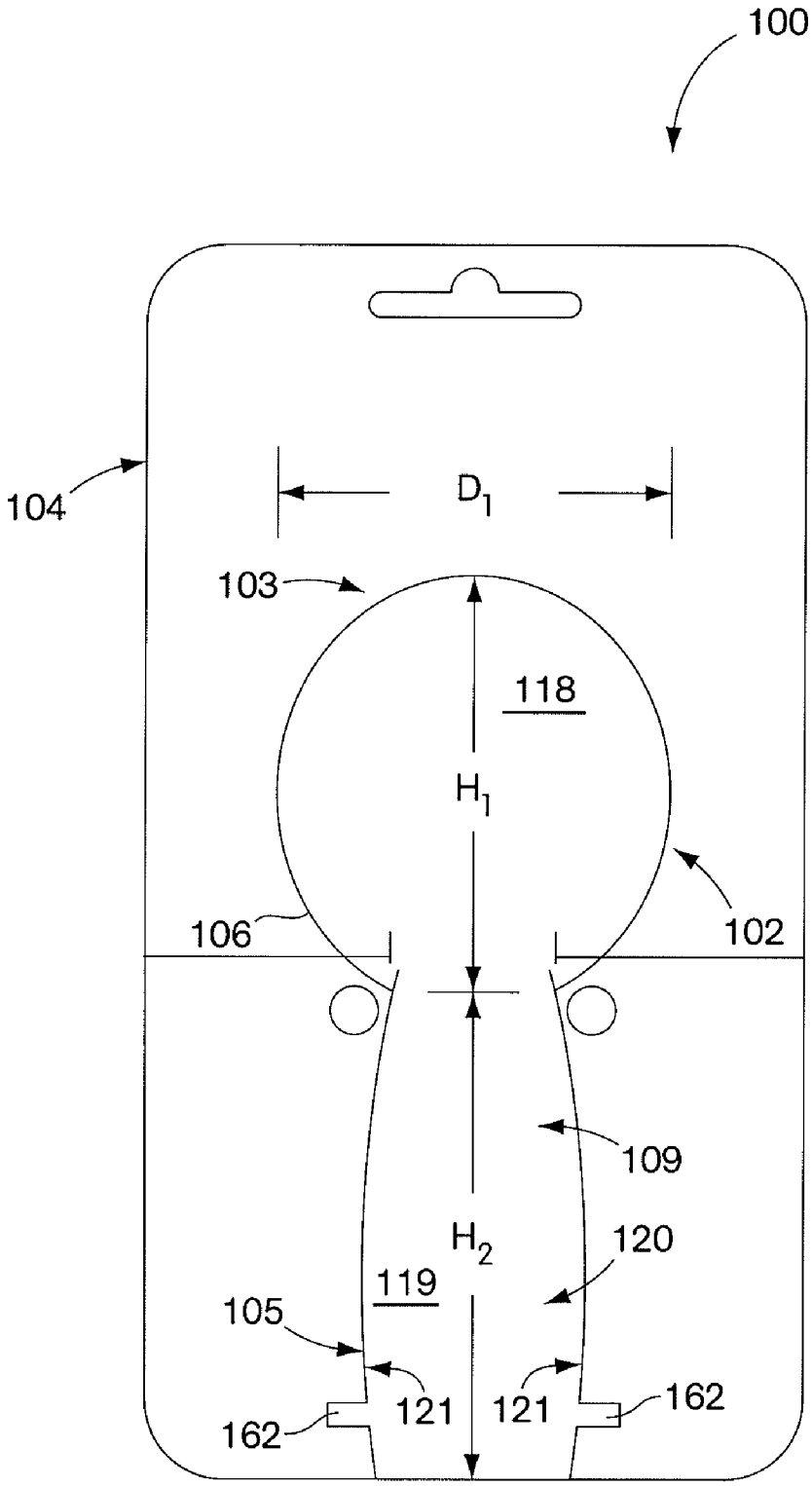
FIG. 9D is a front view of the packaging system shown in FIG. 7 configured to mate with the clasp shown in FIGS. 9A-9B.
Figure 9E:
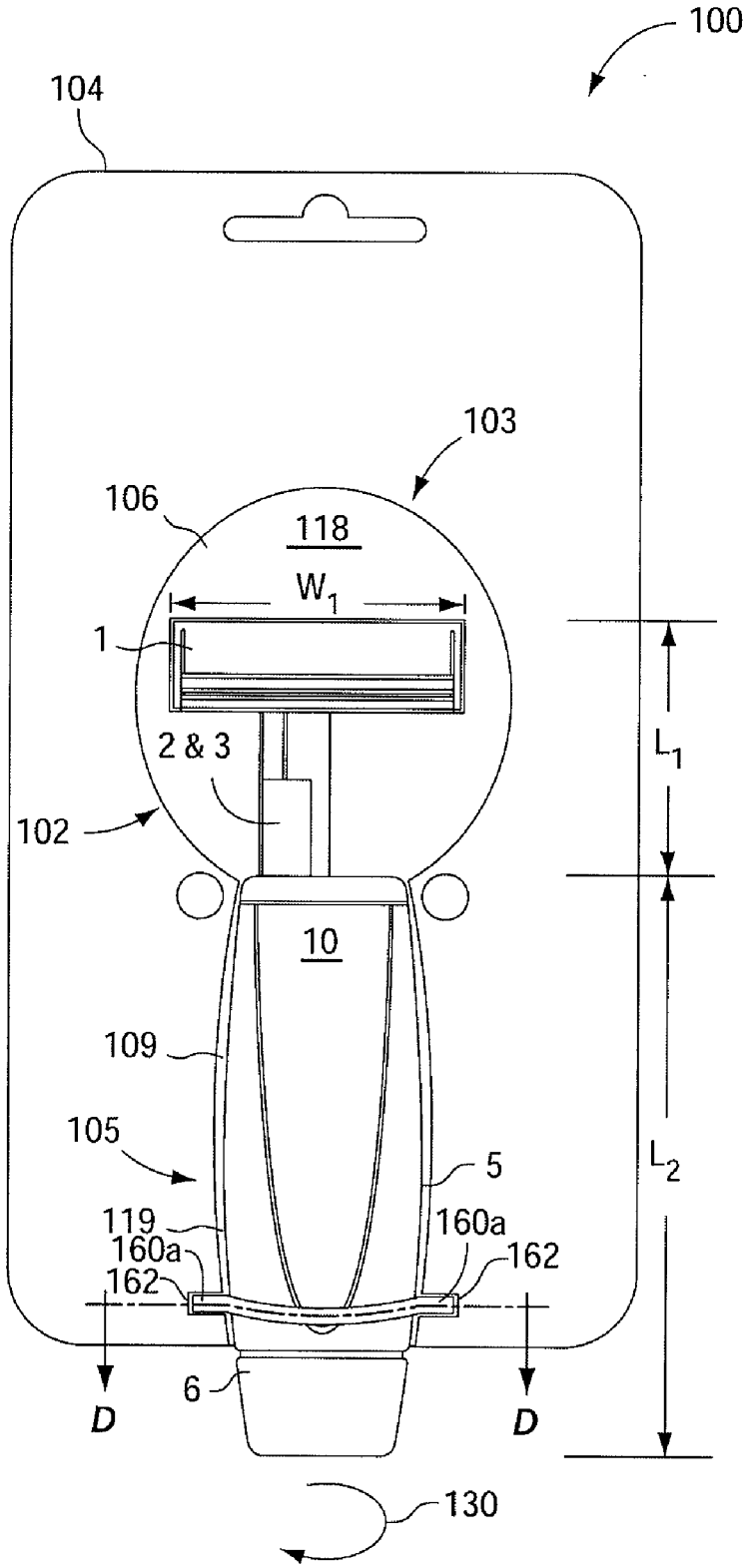
FIG. 9E is a front view of the razor assembly shown in FIG. 1 disposed with the clasp shown in FIGS. 9A-9B in the packaging system shown in FIG. 7.

Referring to FIGS. 9D-9E, each tab (160*a*) is further configured for insertion into a mounting notch (162) defined along an inner edge (121) of the insert card (104) and/or along inner edges of the front and the rear pieces (106) and (108) of the clamshell assembly (102). The inner edge (121) defines a cut-out or a notch (120) in the insert card (104) that is shaped and sized to accommodate the razor assembly (10) when disposed with the insert card (104). As shown in FIG. 9D, two mounting notches (162) are defined along the inner edge (121) and/or inner edges of the front and the rear pieces (106) and (108). The mounting notches (162) are disposed on opposites sides of the cut-out (120). Each tab (160*a*) of the clasp (160) can insert into one of the mounting notches (162) to dispose the razor assembly (10) in the packaging system (100), e.g., in a substantially upright position, as shown in FIG. 9E. In one embodiment, the tabs (160*a*) are sized such that when the tab (160*a*) is inserted into its respective mounting notch (162), the tab (160*a*) is biased against an internal surface defining the notch (162) to help to provide a secure connection.

With the clasp (160) mounted to the outer cylinder (5), the razor assembly (10) can be disposed between the front and the rear pieces (106) and (108) and inserted along the cut-out (120). Each tab (160*a*) can be mated with its respective mounting notch (162) along the inner edge (121) to connect the razor assembly (10) to the packaging (100) system.

In this context, in one embodiment, the packaging system (100) permits a user to turn or rotate the actuating element (6) of the razor assembly (10) when the assembly (10) is disposed in the packaging system (100), as shown by arrow 130 in FIG. 9E, without substantial movement of the assembly (10) within the packaging system (100). As described above, the configuration of the clasp (160), and/or the insert card (104) and the front and rear pieces (106) and (108), help to mount and to immobilize the razor assembly (10) to remain in a substantially stationary position when the actuating element (6) is rotated. A user can thereby turn or rotate the actuating element (6) to engage the propel/repel system, or the actuating mechanism, of the razor assembly (10) to raise the blade support (1) and the blade adjustment assembly (2 and 3) from within the handle assembly (4 and 5), and to lower or retract the blade support (1) and the blade mounting assembly (2 and 3) into the handle assembly (4 and 5). As described below in further detail, in one embodiment, the front piece (106) and the rear piece (108) can be constructed of translucent or transparent material to permit a user to visually inspect the razor assembly (10) while contained in the packaging system (100). A user, therefore, can rotate or turn the actuating element (6) to propel and retract the blade support (1) and the blade support assembly (2 and 3) from the handle assembly (4 and 5) and to thereby provide the user with a visual and tactile self-demonstration of the retraction feature of the razor assembly (10).

As noted above, the diameter $D_1$ and the height $H_1$ define the upper cavity (118) to accommodate the blade support (1) and the blade support assembly (2 and 3), and to provide sufficient space for clearance of the blade support (1) and the blade support assembly (2 and 3) such that the blade support (1) and the blade support assembly (2 and 3) are propelled from and retracted into the handle assembly (4 and 5) without contacting the upper portion (103). The upper portion (103) is further sized and configured such that the blade support (1) can shift within the upper cavity (118) from the second or "closed" position, when the blade support (1) emerges from the handle assembly (4 and 5), to the first or "open" position without contacting the upper portion (103).

The clamshell assembly (102) is constructed of a translucent or transparent material suitable for permitting visual inspection of the razor assembly (10), or other devices and products, disposed within the chamber (109). The assembly (102) can be constructed of a material suitable for providing rigidity sufficient to retain a shape and configuration of the assembly (102). A material suitable for resisting pressure or a manual force applied to an exterior surface of the front and/or the rear piece (106) and (108) is preferable to protect the contents of the packaging system (100). A suitable material includes, but is not limited to, translucent, transparent, clear or clarified plastics, e.g., molded plastics such as polyvinyl chloride (PVC) or polystyrene (PS).

Figure 11:
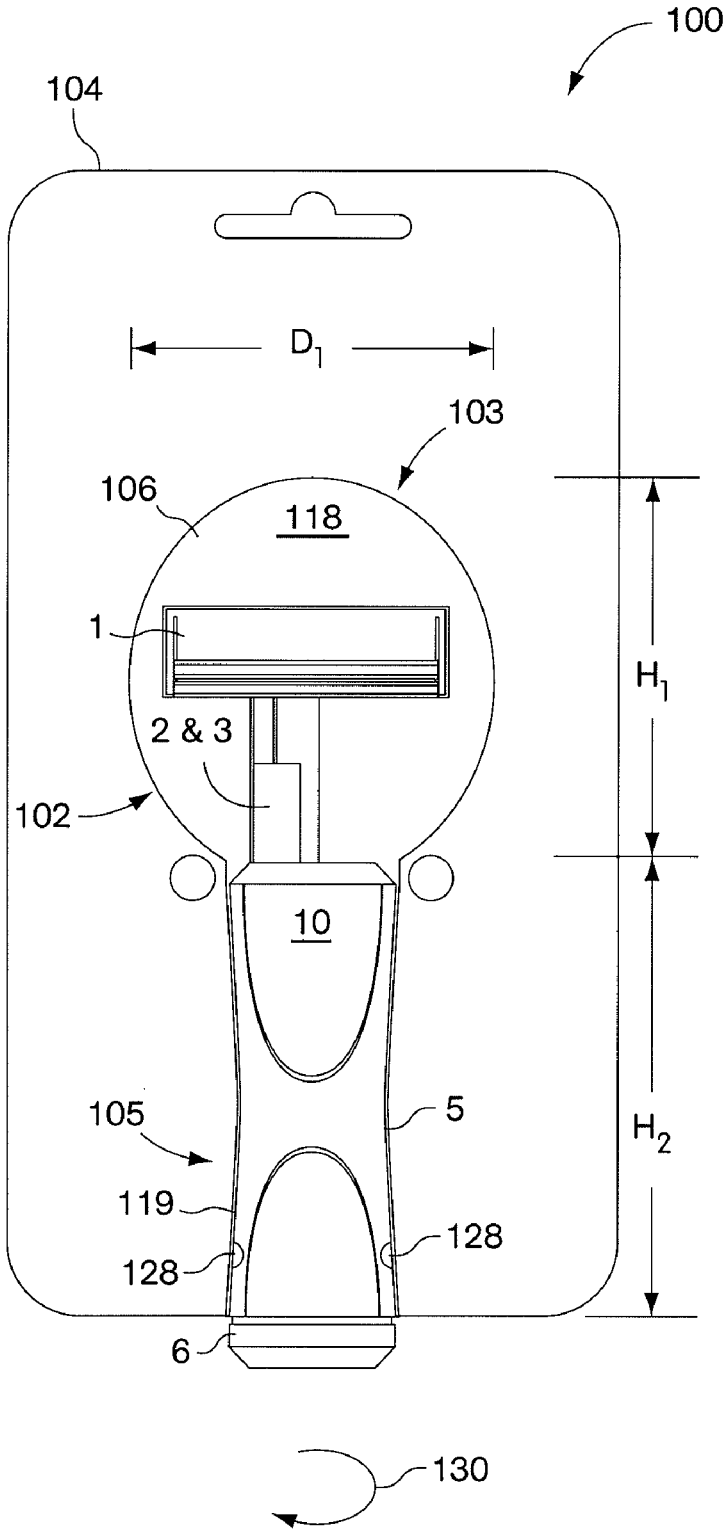
FIG. 11 is a front view of the packaging system shown in FIG. 7 containing the razor assembly shown in FIG. 6 with a concave shape handle.
Figure 12:
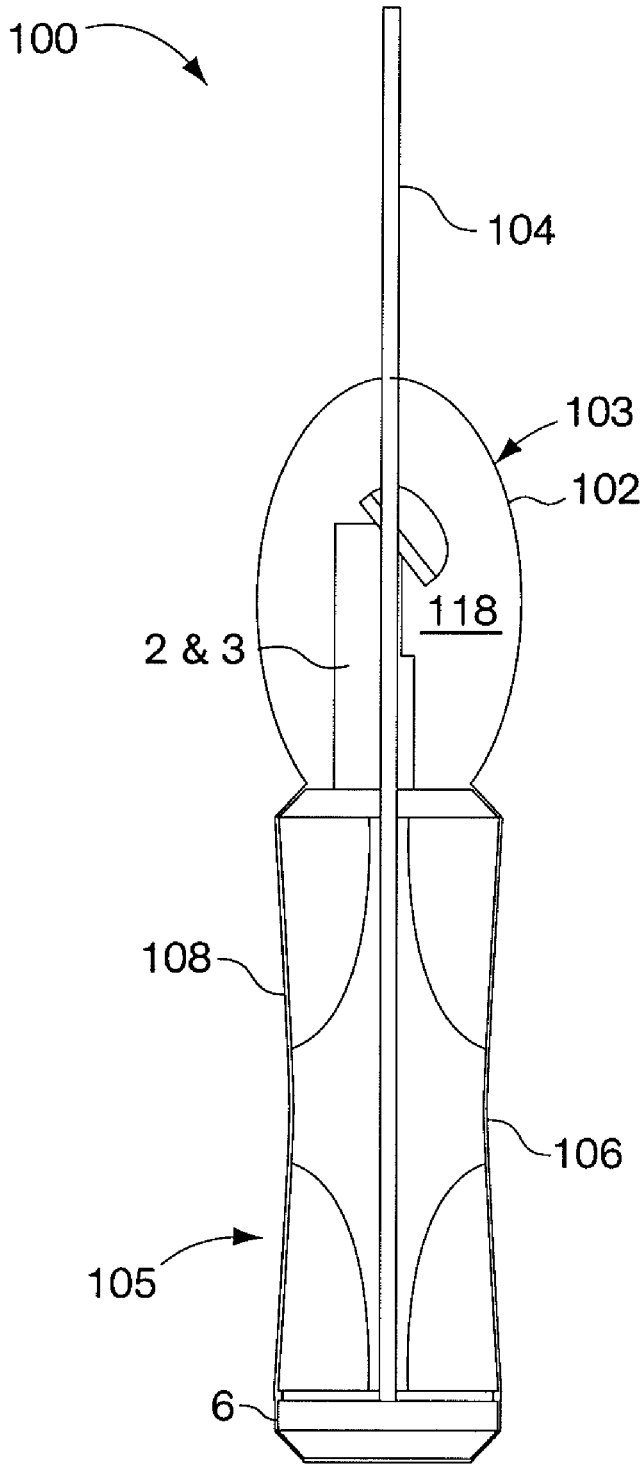
FIG. 12 is a side view of the packaging system containing the razor assembly shown in FIG. 1.

The clamshell assembly (102) of the invention is not limited by the first shape and size of the upper portion (103) and the second shape and size of the lower portion (105) and anticipates that the front piece (106) and the rear piece (108) can have any shape and size required to securely contain and to display different items and, in particular, different consumer devices or products. For example, referring to FIGS. 11 and 12, the packaging system (100) can be constructed and arranged to accept and contain the razor assembly (10) with the cylinder (5) of the handle assembly (4 and 5) having a concave shape or outer profile. The second shape and size of the lower portion (105) have an internal configuration and dimensions to define the lower cavity (119) such that the lower cavity (119) can accept and provide sufficient room for a concave-shaped handle of the razor assembly (10).

Figure 13:
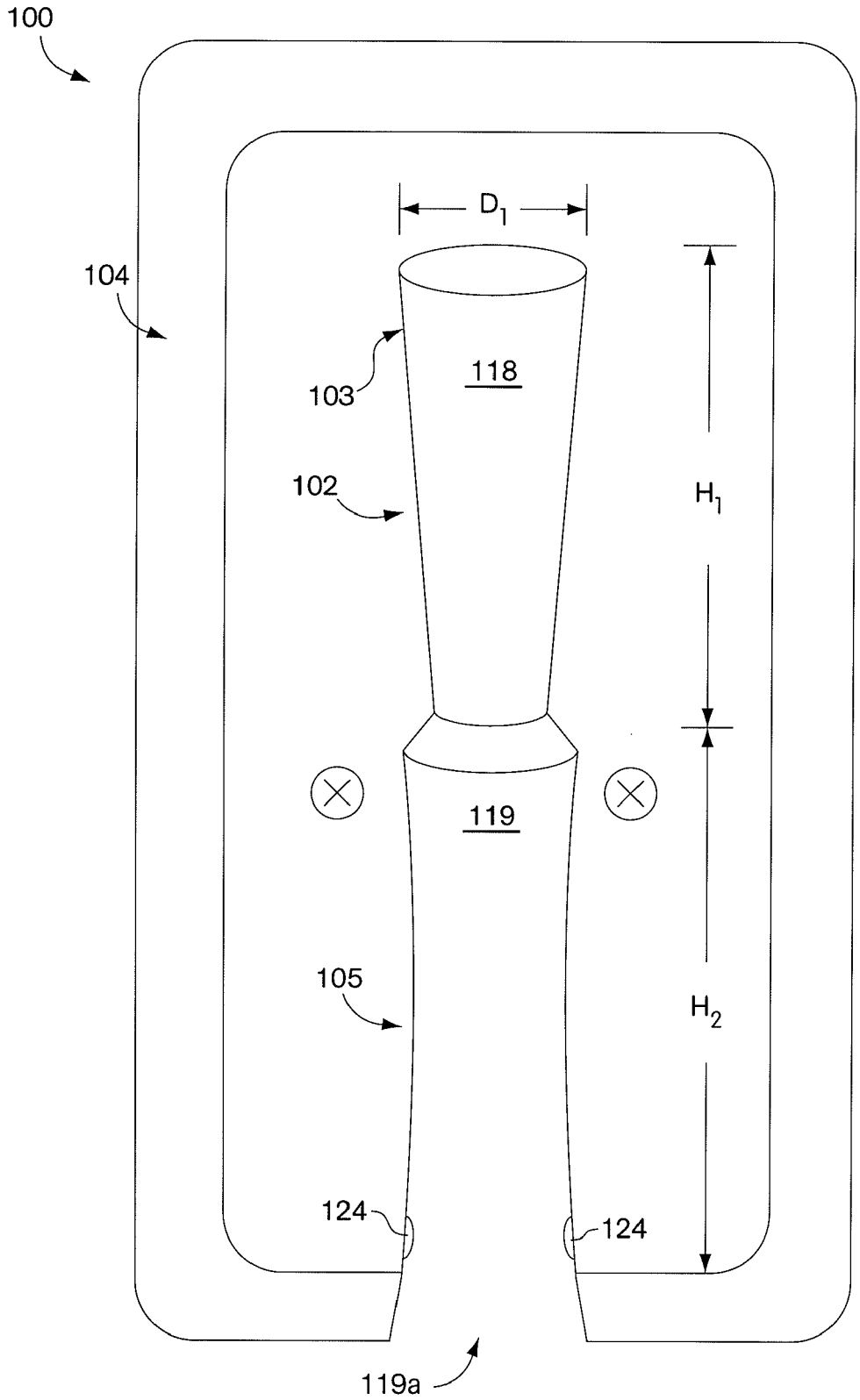
FIG. 13 is a front view of another embodiment of the packaging system according to the invention.
Figure 14:
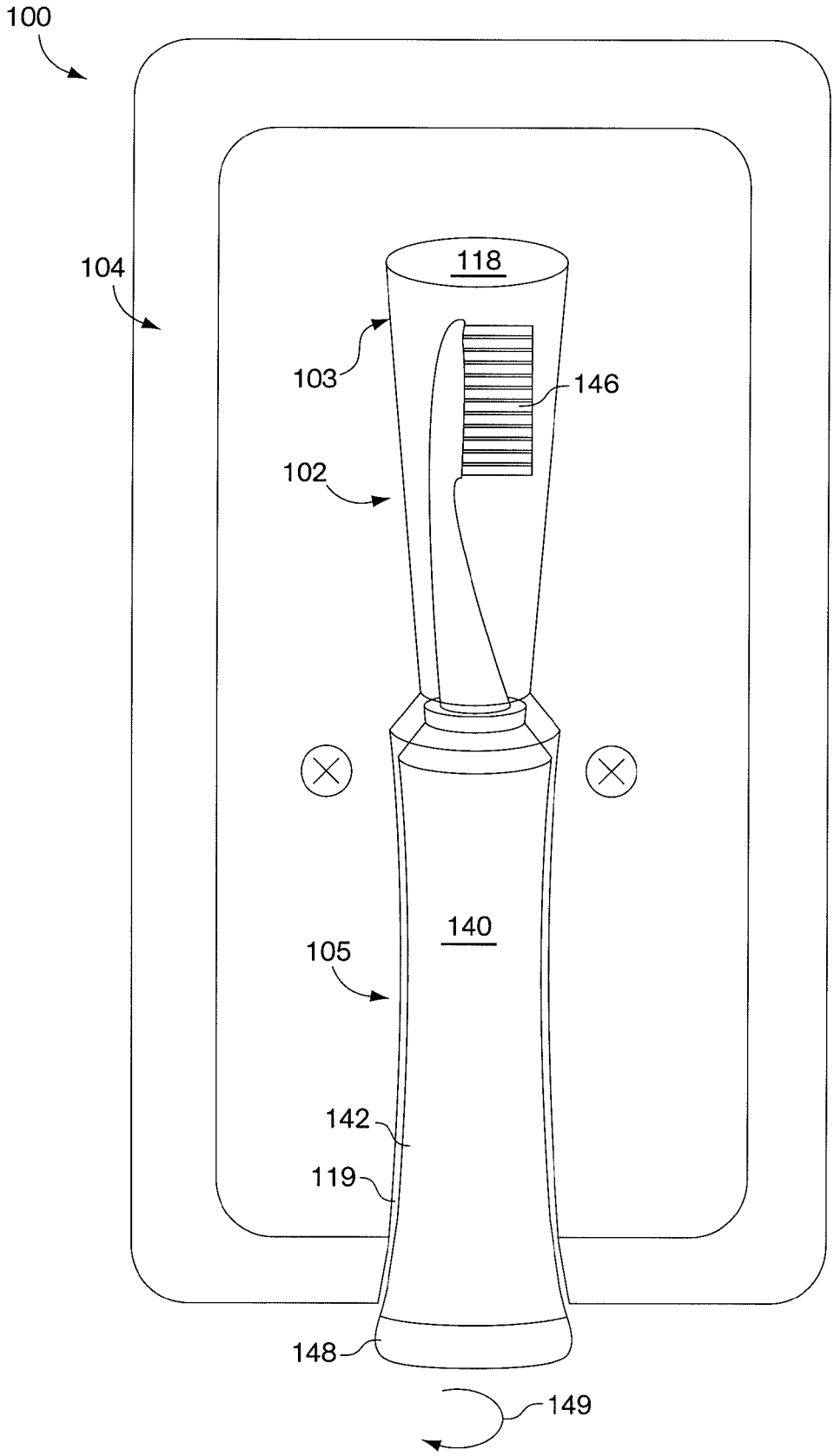
FIG. 14 is a front view of the packaging system shown in FIG. 13 containing a retractable toothbrush.

In another example, referring to FIGS. 13-14, in one embodiment, the packaging system (100) can be constructed and arranged to accept and contain a retractable toothbrush (140). The first shape and the first size of the upper portion (103) provide an internal configuration defining the upper cavity (118) such that the upper cavity (118) accommodates an elongated upper portion and bristle head (146) of the toothbrush (140). The lower cavity (118) is defined by an internal configuration of the second shape and size of the lower portion (105) to accommodate an elongated handle (142) of the toothbrush (140). An actuating member (148) of the toothbrush (140) extends from the opening (119*a*) of the lower portion (105) such that a user can rotate or turn the actuating member (148), as shown by arrow (149) in FIG. 14, to propel and retract the bristle head (146) within the handle (142).

In addition, the packaging system (100) of the invention is not limited to the configurations and the dimensions described above and anticipates the packaging system (100) can define different configurations and dimensions to package different types of devices and products, while displaying and providing consumers with an ability to interact with such devices and products.

Figure 15:
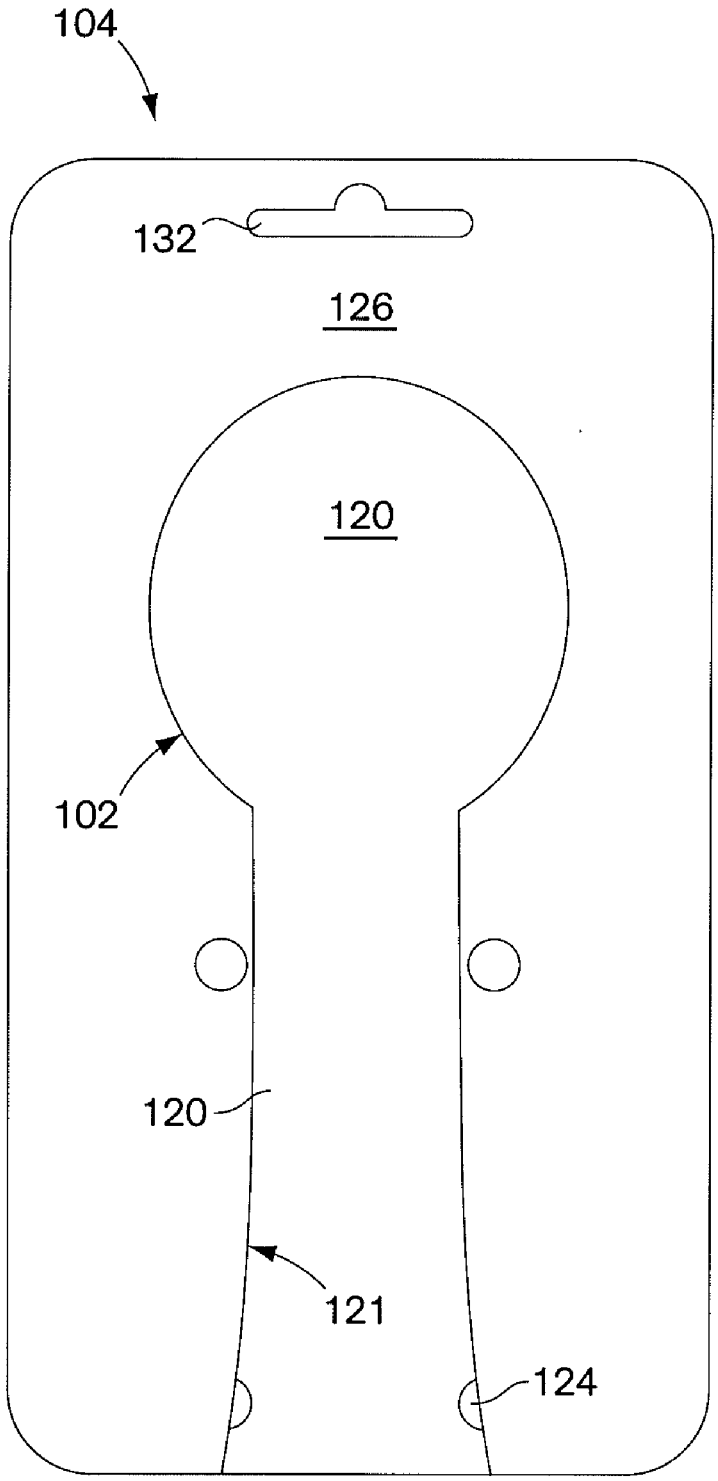
FIG. 15 is a front view of a card insert of the packaging system shown in FIG. 7.

Referring to FIG. 15, the insert card (104) includes a plane (126), e.g., a single sheet of cardstock, paper, plastic or plastic laminate, configured to receive the clamshell assembly (102). The insert card (104) is further configured to permit the clamshell assembly (102) to be disposed within the insert card (104) such that each of the front and the rear piece (106) and (108) protrudes or extends from one side of the insert card (104) with little or no obstruction of a visual display of the razor assembly (110), when contained in the clamshell assembly (102). The insert card (104) includes the notch or cut-out (120), as described above, along the internal edge (121) of the plane (126). The internal edge (121) defines a perimeter or shape of the cut-out (120) suitable for receiving the clamshell assembly (102) and a product to be disposed therein, e.g., the razor assembly (10).

As shown in FIG. 15, in one embodiment, the insert card (104) further includes one or more tabs (124). The internal edge (121) defines one or more tabs (124) along the perimeter of the cut-out (120). Each tab (124) is sized and configured such that one of the recesses (128) defined in the outer surface of the outer cylinder (5) of the handle assembly (4 and 5) can receive the tab (124). Each tab (124) is disposed along the internal edge (121) such that where the razor assembly (10) is disposed within the clamshell assembly (102), the corresponding recess or slot (128) along the outer cylinder (5) of the handle assembly (4 and 5) receives one of the tabs (124). Each tab (124) is further configured to permit a secure fit of the tab (124) in its corresponding recess or slot (128) to thereby securely mount the razor assembly (10) within the clamshell assembly (102) and to help to dispose the razor assembly (10) within the packaging system (100). In one embodiment, the recesses or slots (128) are disposed such that where the actuating member (6) of the razor assembly (10) is turned or rotated to propel or retract the blade support (1), the razor assembly (10) remains in a substantially stationary position with the clamshell assembly (102). The tabs (124) are sized and configured such that the corresponding size and configuration of the recesses or slots (128) do not affect the aesthetic or structural integrity of the razor assembly (110). The insert card (104) can further define an aperture or slot (132) configured to permit the insert card (104) to be hung or mounted to a display device for displaying and dispensing the razor assembly (10) in the packaging system (100).

In one embodiment, the insert card (104) can include a plurality of tabs (124), or similar protrusions (not shown), as an alternative to or in addition to the tabs (124) as shown in FIG. 15, such that the packaging system (100) can accommodate shapes and sizes of different devices or consumer products. Embodiments of the insert card (104) can include artwork, identifying marks and other information about the razor assembly (10), or other consumer device or product.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting.

What is claimed is:

1. A retractable razor assembly comprising:

a blade support including a first surface constructed and arranged to receive and to mount at least one blade assembly to the blade support;

a blade mounting assembly connected to the blade support including a first mounting element and a second mounting element, the first and second mounting elements moveably connected to one another via a tongue and groove combination including a longitudinal groove that the first mounting element defines along a portion of its length that is configured to receive at least a portion of a longitudinal tongue that the second mounting element defines along a portion of its length to couple the first and second mounting elements, the groove being further configured to permit the tongue to slide along at least a portion of the groove such that the second mounting element slides against the first mounting element that remains stationary relative to the second mounting element;

an upper portion of the first mounting element defining an opening configured to receive at least a portion of a fixing stem defined along a second surface of the blade support to pivotally connect the blade support to the first mounting element;

an upper portion of the second mounting assembly defining a protrusion and the second surface of the blade support defining a channel configured to receive at least a portion of the protrusion and to permit the protrusion to slide along a length of the channel;

an inner cylinder defining along a portion of its length two guide slots;

a protruding stem defined along an outer surface of each of the first and second mounting elements, the stems configured such that each guide slot of the inner cylinder accepts a portion of one stem when the blade mounting assembly is inserted within an interior of the inner cylinder;

an outer cylinder constructed and arranged to receive the inner cylinder and the blade mounting assembly, an interior surface of the outer cylinder defining a first spiral guide path and a second spiral guide path extending along a length of the outer cylinder, each of the first and second guide paths configured to receive at least a portion of one of the protruding stems, the first spiral guide terminating to a detent configured and disposed in an upper portion of the outer cylinder to receive at least a portion of the protruding stem along the second mounting element and to bias the portion of the protruding stem against the detent to provide resistance to movement; and an actuating element constructed and arranged to operatively connect to the inner cylinder to join the actuating element to the outer cylinder and to rotate the inner cylinder within the outer cylinder, wherein where the actuating element is rotated, the inner cylinder and the blade support assembly rotate vertically within the outer cylinder with the protruding stems sliding vertically along the first and second spiral paths and the guide slots of the inner cylinder, and where the blade support assembly emerges from the outer cylinder, the first mounting element completes its extension first with the second mounting element sliding along the groove of the first mounting element to extend its protrusion, and the protrusion gliding along the blade support channel and pushing the blade support vertically such that the blade support pivots about the fixing stem to a horizontal orientation relative to the outer cylinder and the detent receives the portion of the protruding stem of the second mounting element to lock the blade support in place.

2. The retractable razor assembly of claim 1 wherein the first mounting element is larger than the second mounting element in terms of size and weight to provide stability to the blade support.

3. The retractable razor assembly of claim 1 wherein the second mounting element protrusion slides along the blade support channel and pushes the blade support to a first open position at a horizontal orientation to the outer cylinder and to retract the blade support to a second retracted position at a vertical orientation to and within the outer cylinder.

4. The retractable razor assembly of claim 1 wherein the outer cylinder is sized and configured to enclose the blade support and the blade mounting assembly when the blade support is in the retracted position.

5. The retractable razor assembly of claim 1 wherein the first spiral guide path is longer than the second spiral guide path.

6. The retractable razor assembly of claim 1 wherein the guide slots of the inner cylinder have different widths from one another and the protruding stems of the first and second mounting elements have different sizes from one another.

7. The retractable razor assembly of claim 1 wherein the guide slots of the inner cylinder are diametrically opposed, and wherein the protruding stems of the first and second mounting elements are diametrically opposed.

8. The retractable razor assembly of claim 1 wherein the guide slots of the inner cylinder are disposed asymmetrically relative to one another, and wherein the protruding stems of the first and second mounting elements are disposed asymmetrically relative to one another.

9. The retractable razor assembly of claim 1 wherein the inner cylinder includes one or more tabs along an outer surface and the actuating element includes one or more notches, each notch adapted to receive at least a portion of one of the tabs.

10. The retractable razor assembly of claim 1 wherein the one or more tabs of the inner cylinder includes two tabs diametrically opposed and the one or more notches of the actuating element includes two notches diametrically opposed.

* * * * *

UNITED STATES PATENT AND TRADEMARK OFFICE

CERTIFICATE OF CORRECTION

PATENT NO. : 7,805,846 B2
APPLICATION NO. : 12/407995
DATED : October 5, 2010
INVENTOR(S) : James M. Leventhal et al.

It is certified that error appears in the above-identified patent and that said Letters Patent is hereby corrected as shown below:

In the Claims:

Claim 14, column 22, line 1;

"The retractable razor assembly of claim 1 wherein the"

Should read

--The retractable razor assembly of claim 3 wherein the--

Signed and Sealed this

Thirtieth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,805,846 B2
APPLICATION NO. : 12/407995
DATED : October 5, 2010
INVENTOR(S) : James M. Leventhal et al.

It is certified that error appears in the above-identified patent and that said Letters Patent is hereby corrected as shown below:

In the Claims:

Claim 4, column 22, line 1;

"The retractable razor assembly of claim 1 wherein the"

Should read

--The retractable razor assembly of claim 3 wherein the--

This certificate supersedes the Certificate of Correction issued November 30, 2010.

Signed and Sealed this
Twenty-fifth Day of January, 2011

David J. Kappos

David J. Kappos
*Director of the United States Patent and Trademark Office*